US008063725B2

(12) United States Patent
Ellis et al.

(10) Patent No.: US 8,063,725 B2
(45) Date of Patent: Nov. 22, 2011

(54) FORM C RELAY AND PACKAGE USING SAME

(75) Inventors: Travis S. Ellis, Portland, OR (US); Mark E. Titterington, North Kingstown, RI (US); Stephen Day, Saunderstown, RI (US); Paul Dana Wohlfarth, Vernonia, OR (US)

(73) Assignee: Coto Technology, Inc., North Kingstown, RI (US)

( * ) Notice: Subject to any disclaimer, the term of this patent is extended or adjusted under 35 U.S.C. 154(b) by 247 days.

(21) Appl. No.: 12/423,445

(22) Filed: Apr. 14, 2009

(65) Prior Publication Data

US 2009/0256662 A1 Oct. 15, 2009

Related U.S. Application Data

(60) Provisional application No. 61/045,174, filed on Apr. 15, 2008.

(51) Int. Cl.
*H01H 1/66* (2006.01)

(52) U.S. Cl. ..... 335/151; 335/152

(58) Field of Classification Search ..... 335/151–154
See application file for complete search history.

(56) References Cited

U.S. PATENT DOCUMENTS

| | | | | |
|---|---|---|---|---|
| 3,461,386 | A | 8/1969 | McCutcheon et al. | |
| 3,575,678 | A | 4/1971 | Barton | |
| 3,689,079 | A * | 9/1972 | Matsuda et al. | 369/33.01 |
| 3,940,722 | A | 2/1976 | Fox et al. | |
| 3,993,970 | A | 11/1976 | Brownell | |
| 4,063,205 | A | 12/1977 | Miknaitis | |
| 4,286,241 | A | 8/1981 | Olivenbaum et al. | |
| 4,547,756 | A | 10/1985 | Miller et al. | |
| 4,943,791 | A | 7/1990 | Holce et al. | |
| 5,103,195 | A | 4/1992 | Dunsmore | |
| 5,438,307 | A | 8/1995 | Chou | |
| 5,568,111 | A | 10/1996 | Metsler | |
| 5,684,441 | A | 11/1997 | Graeber et al. | |
| 5,963,116 | A | 10/1999 | Endoh et al. | |
| 6,025,768 | A | 2/2000 | Martich | |
| 6,052,045 | A | 4/2000 | Martich | |
| 6,294,971 | B1 | 9/2001 | Martich | |

(Continued)

FOREIGN PATENT DOCUMENTS

DE 102004032928 A1 1/2006

(Continued)

OTHER PUBLICATIONS

Beigel, J., "Characterizing Reed Relays Past 7 GHz", May 2004, Penton Media, Inc. 2008, http://www.mwrf.com/Articles/ArticleID/8085/8085.html.

(Continued)

*Primary Examiner* — Ramon Barrera
(74) *Attorney, Agent, or Firm* — Barlow, Josephs & Holmes, Ltd.

(57) ABSTRACT

The improved reed relay package provided a "pseudo" Form C relay that includes two Form A relays with at least one bridge filter element electrically interconnecting the signal outputs thereof to reduce stub capacitance and improve RF performance. As a result, the reed relay package can operate at very high frequencies, such as 18 GHz and higher. Also, vias can be provided through the support substrate to simulate a co-planar waveguide and RF shields profiled with cut-outs to better simulate a 50 ohm impedance environment throughout the path of the signal line.

5 Claims, 20 Drawing Sheets

U.S. PATENT DOCUMENTS

| | | | |
|---|---|---|---|
| 6,329,891 | B1 | 12/2001 | Hayashi et al. |
| 6,329,892 | B1 | 12/2001 | Wohlfarth et al. |
| 6,392,866 | B1 | 5/2002 | Dinteman |
| 6,429,758 | B1 | 8/2002 | Emelo et al. |
| 6,646,527 | B1 | 11/2003 | Dove et al. |
| RE38,381 | E | 1/2004 | Martich |
| 6,683,518 | B2 | 1/2004 | Motta |
| 6,911,889 | B2 | 6/2005 | Bodley et al. |
| 6,937,040 | B2 | 8/2005 | Maeda et al. |
| 6,954,126 | B2 | 10/2005 | Beigel et al. |
| 6,960,972 | B2 | 11/2005 | Nakamura et al. |
| 7,053,729 | B2 | 5/2006 | Aguirre et al. |
| 7,091,424 | B2 | 8/2006 | Oggioni et al. |
| 7,307,499 | B2 | 12/2007 | Nakamura et al. |
| 7,321,282 | B2 | 1/2008 | Lee et al. |
| 2002/0158730 | A1 | 10/2002 | Okano et al. |
| 2006/0254814 | A1 | 11/2006 | Sze et al. |
| 2007/0025257 | A1 | 2/2007 | Xu |

FOREIGN PATENT DOCUMENTS

| | | | |
|---|---|---|---|
| JP | 3203141 | A1 | 9/1991 |
| JP | 4005606 | U | 1/1992 |
| JP | 5198237 | A | 8/1993 |
| JP | 11162309 | A | 6/1999 |
| JP | 2002025410 | | 1/2002 |
| JP | 2003323839 | A | 11/2003 |
| JP | 2004185896 | | 7/2004 |
| WO | 0223566 | A2 | 3/2002 |

OTHER PUBLICATIONS

Xu, Liang-Jun, Zhang, Ji-Gao, "A New Design of Multi-Contact Reed Relay for Improving Switching Load Capacity", IEEE 1998, pp. 214-219.

Rhopoint Components.com, "Reed Relays:", http://www.rhopointcomponents.com/.

Fullem, J., Bateman, J., "Reed relays designed to handle fast pulses and FR applications", Conference Article (CA), Proceedings, 37th Relay Conference.

Seineke, S., "Coaxial relay switches with dry-reed contacts for the transmission of subnanosecond pulses", Nachrichtentechnishe Zeitschrift, Journal article (JA), vol. 29, Issue 4, Apr. 1976, Germany.

Keller, A. C., "Relays and Switches", Proceedins of the Ire, Jun. 16, 1961, Bell Telephone Laboratories, NY.

Cormack, George D., "Time-Domain Reflectometer Measurement of Insertion Loss of High-Frequency Switches", IEE Transactions on Instrumentation and Measurement, vol. IM-22, No. 4, pp. 291-295, Dec. 1973.

* cited by examiner

| TEST PARAMETERS | CONDITIONS[1,2] | MIN | NOM | MAX | UNITS |
|---|---|---|---|---|---|
| COIL SPECIFICATIONS | | | | | |
| COIL RESISTANCE | | 49.5 | 55.0 | 60.5 | Ω |
| NOMINAL VOLTAGE | | | 5.0 | 4.0 | VOLT |
| MUST OPERATE | 3.3 VDC COIL | | | 2.4 | VOLT |
| MUST RELEASE | | 0.4 | | | VOLT |
| COIL RESISTANCE | | 135.0 | 150.0 | 165.0 | Ω |
| NOMINAL VOLTAGE | 5.0 VDC COIL | | 5.0 | 6.0 | VOLT |
| MUST OPERATE | | | | 3.8 | VOLT |
| MUST RELEASE | | 0.4 | | | VOLT |
| CONTACT RATINGS | | | | | |
| SWITCHING VOLTAGE | MAX VDC/PEAK AC | | | 125.0 | VOLT |
| SWITCHING CURRENT | | | | 0.3 | AMP |
| CARRY CURRENT (CONTINUOUS) | SWITCH & SHIELD | | | 0.5 | AMP |
| CONTACT RATING (RESISTIVE LOAD) | RESISTIVE LOAD | | | 3.0 | WATT |
| LIFE EXPECTANCY SIGNAL SWITCHING G3 | 1 VDC/10 mA | | 1000 | | $10^6$ OPS |
| LIFE EXPECTANCY RESISTIVE LOAD3 | 12 VDC/10 Ma | | | | $10^6$ OPS |
| LIFE EXPECTANCY OTHER LOAD CONDITIONS3 | CONSULT FACORY | | | | |
| RELAY SPECIFICATIONS | | | | | |
| STATIC CONTACT RESISTANCE (INITIAL) | 0.05 VDC/50 mA@100Hz, 1.5 ms | | | 125 | Ω |
| DYNAMIC CONTACT RESISTANCE (INITIAL) | 0.05 VDC/10 mA | | | 0.15 | Ω |
| INSULATION RESISTANCE ALL ISOLATED OINS | 100 VDC | $10^{10}$ | $10^{12}$ | | Ω |
| CAPACITANCE ACROSS CONTACTS | SHIELD GUARDING | | 0.2 | | pF |
| CAPACITANCE OPEN CONTACTS TO COIL | SHIELD GUARDING | | 0.5 | | pF |
| CAPACITANCE CLOSED CONTACT TO COIL | SHIELD GUARDING | | 1.0 | | pF |
| DIELECTRIC STRENGTH ACROSS CONTACTS | 100μA | 150 | | | V(DC/PEAK AC) |
| DIELECTRIC STRENGTH CONTACT TO COIL | 100μA | 1500 | | | V(DC/PEAK AC) |
| DIELECTRIC STRENGTH CONTACT TO SHIELD | 100μA | 1500 | | | V(DC/PEAK AC) |
| OPERATE TIME (INCLUDING BOUNCE) | NOMINAL VOLTAGE COIL DRIVE | | 100 | 200 | μs |
| RELEASE TIME (Si DIODE DAMPED) | @30 Hz; SQUARE WAVE | | 30 | 50 | μs |
| RF INSERTION LOSS4 | -3db ROLL-OF FREQUENCY | 16.0 | | | GHz |
| SIGNAL RISE TIME (10% -90%) | CORRECTED FOR MEASUREMENT | | | .. | .. |

FIG. 11

FORM C RELAY AND PACKAGE USING SAME

CROSS REFERENCE TO RELATED APPLICATION

This application is related to and claims priority from earlier filed provisional patent application Ser. No. 61/045,174, filed Apr. 15, 2008, the entire contents thereof is incorporated herein by reference.

BACKGROUND OF THE INVENTION

The present invention relates generally to switching devices. More specifically, the present invention relates to improved packaging and circuit integration for electromagnetic devices, such as reed switches and electromagnetic devices such as reed relays.

Electromagnetic relays have been known in the electronics industry for many years. Such electromagnetic relays include the reed relay which incorporates a reed switch. A reed switch is typically a magnetically activated device that typically includes two flat contact tongues which are merged in a hermetically sealed glass tube filled with a protective inert gas or vacuum. The switch is operated by an externally generated magnetic field, either from a coil or a permanent magnet. When the external magnetic field is enabled, the overlapping contact tongue ends attract each other and ultimately come into contact to close the switch. When the magnetic field is removed, the contact tongues demagnetize and spring back to return to their rest positions, thus opening the switch. It is also possible that the switch does not have a glass envelope and is not actuated by magnetic force. For example, the envelope may be made of other materials, such as copper, and can be actuated by other forces, such as centripetal, centrifugal and acceleration forces.

Reed switches, actuated by a magnetic coil, are typically housed within a bobbin or spool-like member. A coil of wire is wrapped about the outside of the bobbin and connected to a source of electric current. The current flowing through the coil creates the desired magnetic field to actuate the reed switch within the bobbin housing.

FIGS. 1-3 shows further details of the configuration of such a prior art reed switch device discussed above. Turning first to FIG. 1, a perspective view of a prior art reed switch configuration 10 is shown. A known reed switch 11 includes, preferably, a glass envelope 12 as well as two signal leads 14 emanating from opposing ends of the reed switch 11 and coil termination leads 15. The signal leads are connected to a pair of metal contacts 13. It should be noted that other envelopes, such as metal, may be used in a switch that is actuated by other forces, such as centripetal, centrifugal and other acceleration forces. The construction of a reed switch 11 is so well known in the art, the details thereof need not be discussed. A shield conductor 16, commonly made of brass or copper, is provided in the form of a cylindrical sleeve which receives and houses the reed switch 11. The reed switch 11 and shield 16 are housed within the central bore 18 of a bobbin or spool 20. About the bobbin 20 is wound a conductive wire 22. As a result, a co-axial arrangement is formed to protect the reed switch 11 device and to control the impedance of the environment and to improve the overall transmission of the signal. The reed switch 11, shield conductor 16 and bobbin 20 are shown in general as cylindrical in configuration. It should be understood that various other configurations, such as those oval in cross-section, may be employed and still be within the scope of the present invention.

As can be understood and known in the prior art, the free ends of the coil of wire 22, the shield 16 and signal terminals 14 of the reed switch 11 are electrically interconnected to a circuit as desired. The respective components of the reed switch 11 configuration are interconnected to a circuit by lead frame or other electrical interconnection (not shown). The lead frame or other electrical interconnection introduces a discontinuity of the desirable co-axial environment.

As described above, the overall reed switch device 10 must be designed to be easily accommodated within a user's circuit. For example, a circuit used to operate at high frequency is designed with a defined characteristic impedance environment. The goal of designing and manufacturing a reed device 10 to the specifications of a circuit customer is to match the desired impedance of the device 10 to the circuit environment as closely as possible. It is preferred that there is no discontinuity of impedance from the reed device 10 itself to a circuit board trace of the circuit that will receive the device 10. The characteristic impedance, $Z_1$, is generally a function of the outer diameter of the signal conductor 14, the inner diameter of the shield 16 and the dielectric constant of the insulation (not shown) between the signal conductor 14 and the shield 16.

A further modification of the reed switch package of FIG. 1 is shown in FIGS. 2-3. A reed switch device 103 is provided to include an outer bobbin 102 with coil 109 wrapped around it for introducing the necessary magnetic field to actuate the reed switch 111. Ends of wire 109 may be connected to posts, pins, or the like (not shown) connected to bobbin 102 to provide for electrical interconnection of the magnetic field current. Emanating from the reed switch 111 are two signal leads 106 which correspond to opposing sides of the reed switch 111. Also emanating from the bobbin body 102 are a pair of shield or ground tabs 108 on each side of the bobbin body 102 that are electrically interconnected to, as shown in FIG. 6, the ends of the inner shield sleeve 110. As shown in FIG. 3, an exploded perspective view the reed switch 111 of FIG. 2, these ground tabs 108 are extensions from the shield sleeve 110 itself on opposing sides thereof.

In particular, the reed switch 111 includes a signal conductor 106 within a glass capsule 126 with an inert gas or vacuum 128 surrounding it. Positioned about the glass capsule 126 is a ground shield 130 which is preferably of a cylindrical or tubular configuration but may be of an oval cross-section to accommodate certain reed switches 111 or multiple reed switches in a multiple channel environment. The foregoing assembly is housed within the bobbin 102 which includes an energizing coil 109.

Some applications of reed devices require the switch to carry signals with frequencies in excess of 500 MHz. However, there is a continuing need for reed relays to transmit higher and higher frequencies without significant attenuation of the transmitted signal power. Current reed relays can operate up to the range of 8-10 GHz.

However, there is even a further need to increase these operating bandwidth ranges to 18 GHz and possibly even higher. In general, there is a need for a reed relay to have very high RF performance where the RF path is optimized to minimize impedance discontinuities throughout the signal path and to reduce stub capacitance.

In the prior art, it is common for individual reed switches to be employed to form various type of switching functions so that they may be incorporated into a circuit, such as a circuit board for automated test equipment (ATE). For example, as in FIG. 4, a reed switch may be employed as a single throw switching device 50 with a single pole 52. This is known as a "Form A" configuration. Also, a Form C switching environment is possible, as shown in FIG. 5 where a single switch 54 can throw to two different poles 56, 58. It can be understood, such multi-pole switching adds complexity to the device with a higher cost. To address this, "pseudo" Form C configurations are commonly employed in the prior art to simplify the switching and to enable the use of individual reed switch devices that are readily available at relative low cost. Such as "pseudo" Form C switching configuration is shown in the switch arrangement 60 seen in FIG. 6. Two Form A switches 62, 64 are used with a bridge 66 to achieve this configuration. As can be understood, with the appropriate connection comprised of the leads of the switches and traces on a circuit board, the appropriate switching capability can be incorporated into a circuit on a circuit board, such as in automated test equipment (ATE).

However, as is well known in the art, this results in a long, unprotected and vulnerable connection between the terminals of the reed switches and the circuit board which is commonly termed a "stub connection." As a result of this long, unprotected stub connection, significant parasitic capacitance C to ground will be present. This is termed a "stub capacitance" and acts to load the high frequency path, thus limiting the frequency of the circuit to a value in the range of about 5.0 GHz, for example. However, to properly test very fast devices under test (DUT), such as high-speed microprocessors, the frequency of the test circuit must reach the 7 GHz range and even higher, such as 18 GHz and above. Unfortunately, prior art reed switch devices configurations include a stub connection on the circuit board that makes the device essentially incapable of testing high-speed devices.

The foregoing shortcomings in the prior art can be readily understood after viewing an actual circuit into which such a Form C or "pseudo" Form C arrangement of reed switches are incorporated. FIGS. 7 and 8 illustrate such an example circuit environment. Circuit 300 is one that is commonly employed in ATE (Automated Test Equipment) for the purpose of testing circuit devices, generally referenced as 313, and the like. This circuit 300 sets forth a three terminal device that may be "stackable" in series, end to end, depending on the application. A three terminal device 306 with a first reed switch 302 and a second reed switch 304 is shown in FIG. 7 as generally referenced by the dotted lines. For example, the first reed switch device 302 provides a connection for a high frequency AC signal while the second reed switch 304 provides a connection for a DC signal or low frequency AC signal.

More specifically, a signal generator 308 is connected to the first terminal 310 of the first reed switch 302. A second reed switch 304 is provided with a first terminal 312 and a second terminal 314. A second terminal 316 of the first reed switch 302 is connected to the second terminal 314 of the second reed switch 304 at node 318. This node 318 becomes the output terminal 326 to the device 306. A second pair of reed switches 320, 322 is employed to receive the stimulus from the device under test, (DUT) 313. Receiver 317 receives the output from the second pair of reed switches 320, 322. The serial nature of the pair of switches enables a circuit to be designed with a number of different test operations to a different number of DUTs which are independently selectable and isolatable. FIG. 8 illustrates a representational schematic of one of the pair of reed relays that carry out the circuit diagram of FIG. 7.

To carry out this circuit, two individual reed switches are connected to a circuit board (not shown) with the appropriate connection 324 comprised of the leads of the switches and the trace on the circuit board therebetween. This results in a long, unprotected and vulnerable connection between the terminals of the reed switches and the circuit board which is commonly termed a "stub connection." As a result of this long, unprotected stub connection 324, significant parasitic capacitance C to ground will be present. This is termed a "stub capacitance" and acts to load the high frequency path, thus limiting the frequency of the circuit to a value in the range of about 5.0 GHz, for example. However, to properly test very fast devices under test (DUT), such as high-speed microprocessors, the frequency of the test circuit must reach the 7 GHz range and higher, such as 18 GHz, in the future. Therefore, with a prior art mounting of the reed switches 302, 304 and stub connection 324 on the circuit board, this circuitry 300 is incapable of testing high-speed devices. The protection of a this stub connection is an example of many different ways to employ the present invention.

Another concern in the industry concerns impedance matching of the switch to the circuit into which it is installed. Currently available reed devices are incorporated into a given circuit environment by users. For application at higher frequencies, such as in the 18 GHz range and higher, as is well known in the art, a reed switch is ideally configured to match as closely as possible the desired impedance requirements of the circuit, such as 50 ohms, in which it is installed.

To address these impedance matching needs, within a circuit environment, a co-axial arrangement is preferred throughout the entire environment to maintain circuit integrity and the desired matched impedance. As stated above, the body of a reed switch includes the necessary co-axial environment. In addition, the signal trace on the user's circuit board commonly includes a "grounded co-planar waveguide" where two ground leads reside on opposing sides of the signal lead and in the same plane or a "strip line" where a ground plane resides below the plane of the signal conductor. These techniques properly employed provide a controlled impedance transmission line which is acceptable for maintaining the desired impedance for proper circuit function.

This is due to, for example, the fact that the reed switch itself must be physically packaged and electrically interconnected to a circuit board carrying a given circuit configuration. It is common to terminate the shield and signal terminals to a lead frame architecture and enclose the entire assembly in a dielectric material like plastic for manufacturing and packaging ease. These leads may be formed in a gull-wing or "J" shape for surface mount capability. The signal leads or terminals exit out of the reed switch body and into the air in order to make the electrical interconnection to the circuit board. This transition of the signal leads from plastic dielectric to air creates an undesirable discontinuity of the protective co-axial environment found within the body of the switch itself. Such discontinuity creates inaccuracy and uncertainty in the impedance of the reed switch device.

As a result, circuit designers must compensate for this problem by specifically designing their circuits to accommodate and anticipate the inherent problems associated with the discontinuity of the protective co-axial environment and the degradation of the rated impedance of the reed switch device. For example, the circuit may be tuned to compensate for the discontinuity by adding parasitic inductance and capacitance. This method of discontinuity compensation is not preferred because it complicates and slows the design process and can degrade the integrity of the circuit. This is particularly problematic with very high frequency circuit environments, such as ones that operate in the 18 GHz and higher.

However, such tuning compensation schemes only work over a relatively narrow range of frequency. There is a demand to reduce the need to tune the circuit as described above. The prior art uses a structure of carefully designed vias, which are expensive and difficult to manufacture, to control the impedance from the relay to the board transition.

In view of the foregoing, there is a demand for a reed switch device that can reduce the parasitic stub capacitance to achieve higher frequency signals, such as those in the range of 18 GHz and higher. There is a further need to increase RF performance in such a reed switch device environment. There is also a demand for a reed switch device that includes a controlled impedance environment through the entire body of the package to the interconnection to a circuit. There is a particular demand for a reed switch device to be compact and of a low profile for installation into small spaces and for circuit board stacking. There is further a demand for reed switch devices that are of a surface mount configuration to optimize the high frequency of the performance of the system. Further, there is a demand for a reed switch device that can reduce the need to tune a circuit to compensate for an uncontrolled impedance environment. Also, there is a demand for a reed switch device that has a small footprint and is of a standard shape and configuration for simplified manufacture and installation.

Still further, there is a demand for a reed switch device that is capable of performing much faster than prior art reed switch devices, such as in the 18 GHz range and even higher. There is a need for a reed switch device that is suitable for Form C and Form A applications. There is a need to filter out high frequency in the GHz range for improved operation of the device at very high frequencies, such as those in the 18 GHz range and higher. There is a particular need to reduce the degree of attenuation of high frequency signals. There is a desire to match and interconnect the device to a given circuit, such as one that operates in the 50 ohm range. There is a need to optimize the operation of the circuit into which the reed switch device is installed to simulate a co-axial environment. There is also a need to be able to add DC voltage to the high frequency signal. There is yet another need in the prior art to minimize impedance discontinuities by altering the configuration of the shielding of the device.

SUMMARY OF THE INVENTION

The present invention preserves the advantages of prior art electromagnetic switch devices, such as reed relays. In addition, it provides new advantages not found in currently available switching devices and overcomes many disadvantages of such currently available devices.

The invention is generally directed to the novel and unique reed relay device and package with particular application in effectively interconnecting a reed switch device to a circuit on a circuit board in a low profile configuration. The reed switch package of the present invention enables the efficient and effective interconnection to a circuit board while being in an inexpensive construction.

More specifically, a new "pseudo" Form C relay device that may easily operate at frequencies well above the 8-10 GHz range, such as in the 18 GHz range and above, to accommodate the testing of the latest high-speed devices using the latest ATE. The stub capacitance is significantly reduced by uniquely employing low pass filter bridges to block high frequencies in the GHz range. This effectively reduces the attenuation of the high frequency signals to thereby reduce the effect of stub capacitance. Thus, with the present invention, stub capacity can be better controlled and compensated for to improve RF performance. With the present invention, it is also possible that DC can be added to the high frequency signal.

Also, the high-frequency path is protected using the simulated co-axial signal protecting environment. A low profile, board mountable reed relay package is provided by the present invention. A portion of the reed switch extends through an aperture in the relay substrate. The substrate includes a series of electrical contacts, such as solder balls array (BGA), land grid array (LGA), column grid array (CGA), or pin grid array (PGA), mounted to the same side of the substrate that the relay mounts to electrically connect to the main circuit card. The reed switch or switches, such as in a two channel package, are directly electrically connected to the electrical contacts via signal traces and additional electrical traces located on the bottom of the relay substrate which connect to the relay's shielding. These additional traces are routed in a parallel position on both sides of the signal traces to provide a co-planar wave guide to maintain the desired impedance of the signal path. The reed relay device is preferably provided in a BGA package for easy mounting to a circuit board in automated test equipment (ATE).

It is therefore an object of the present invention to provide a compact, low profile reed switch package.

It is an object of the present invention to provide a reed switch device that has improved RF performance.

A further object of the present invention is to provide a reed switch device that better controls and compensates for parasitic stub capacitance between channels to enable the transmission of higher frequency bandwidth of signals.

It is an object of the present invention to provide a reed switch device with a controlled impedance environment throughout the entire package.

A further object of the present invention is to provide a reed switch device that has a pseudo-coaxial environment to maintain a 50 ohm signal path environment.

It is a further object of the present invention to provide a reed switch package that is easily matched to the impedance of an existing circuit environment.

Another object of the present invention is to provide a reed switch package that is capable of efficiently conducting very high frequency signals.

It is yet a further object of the present invention to provide a reed switch package with a small footprint.

Another object of the present invention is to provide a reed switch package that can be easily surface mounted to a main circuit board, such as one that is use for automated test equipment.

An object of the invention is to provide a reed switch device packages that is capable of performing much faster than prior art reed switch devices, such as in the 18 GHz range and even higher.

Another object of the invention is to provide a reed switch device package that is suitable for Form C and Form A applications.

A further object of the invention is to filter out high frequency in the GHz range for improved operation of the device.

A further object of the present invention is to provide high frequency intra-channel isolation in the GHz range for improved operation of the device.

Another object is to reduce the degree of attenuation of high frequency signals in a reed switch device package.

Another object of the present invention is to match and interconnect the device to a given circuit, such as one that operates in the 50 ohm range.

Another object of the present invention is to optimize the operation of the circuit into which the reed switch device package is installed to simulate a co-axial environment.

Yet another object of the invention is to be able to add DC voltage to the high frequency signal.

Another object of the present invention is to minimize impedance discontinuities by altering the configuration of the shielding of the device.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 11 is a table showing the performance parameters of the relay of the present invention;

DETAILED DESCRIPTION OF THE PREFERRED EMBODIMENT

Figure 1:
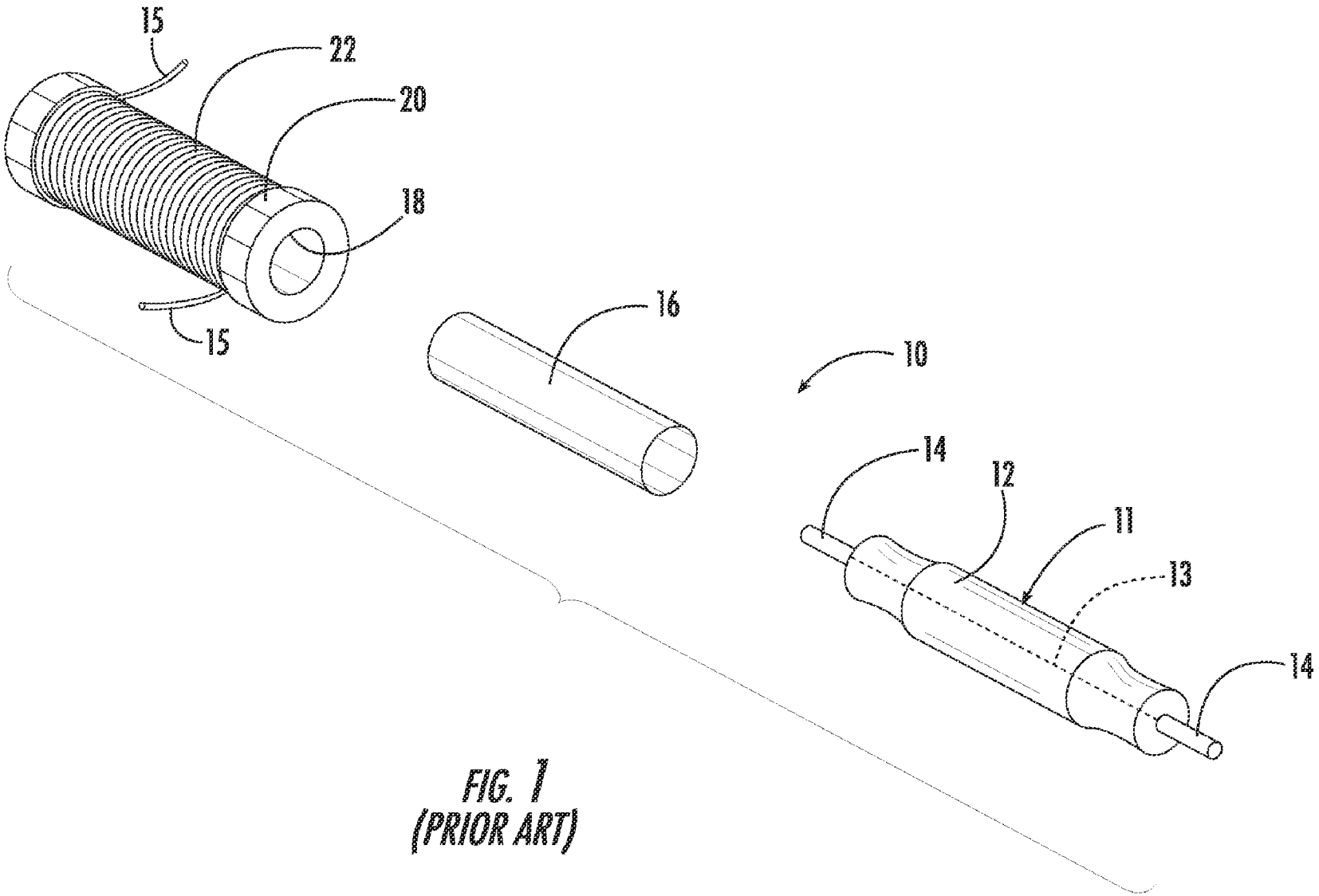
FIG. 1 (PRIOR ART)
FIG. 1 is an exploded perspective view of a prior art reed relay configuration.
Figure 2:
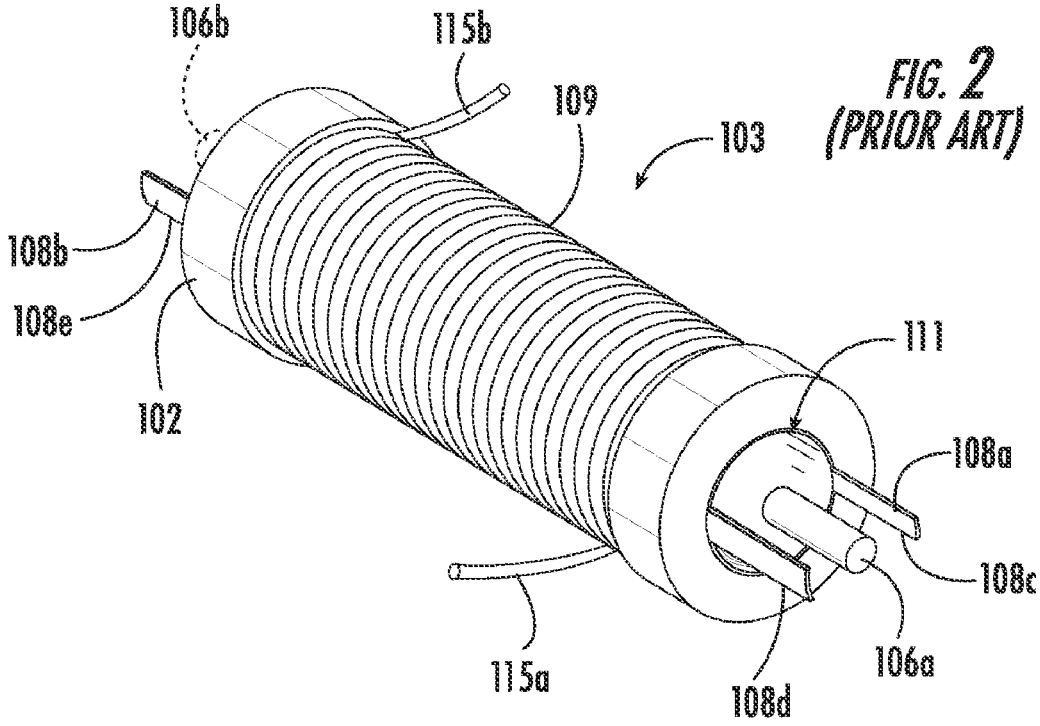
FIG. 2 (PRIOR ART)
FIG. 2 is a perspective view of another embodiment of an assembled prior art reed relay device.
Figure 3:
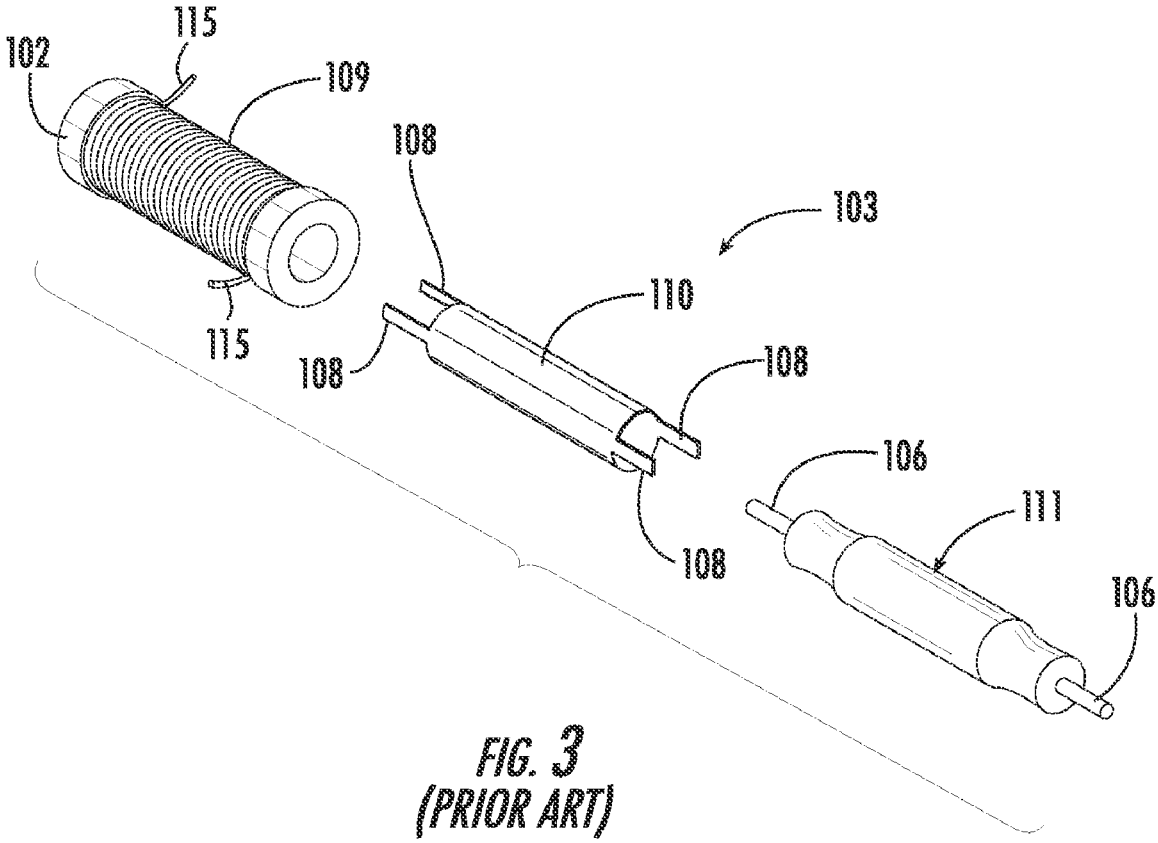
FIG. 3 (PRIOR ART)
FIG. 3 is an exploded perspective view of the prior art reed relay device of FIG. 2.
Figure 4:
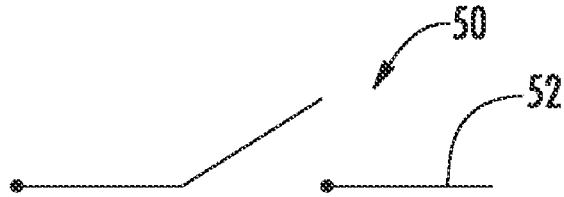
FIG. 4 (PRIOR ART)
FIG. 4 is a schematic view of a Form A switch configuration.
Figure 5:
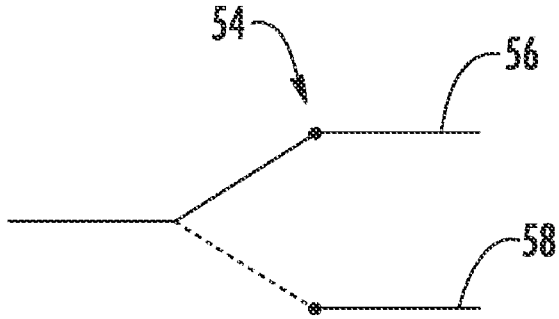
FIG. 5 (PRIOR ART)
FIG. 5 is a schematic view of a Form C switch configuration.
Figure 6:
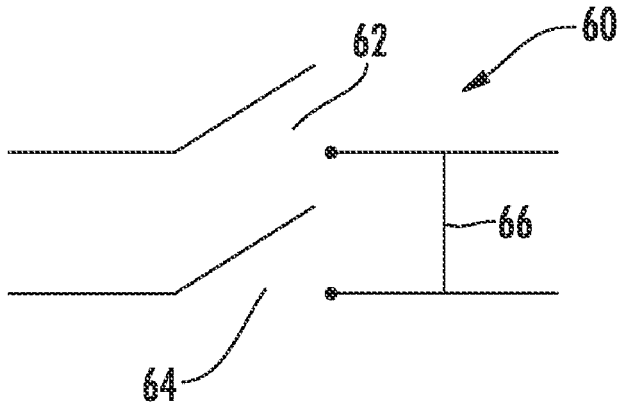
FIG. 6 (PRIOR ART)
FIG. 6 is a schematic view of a "pseudo" Form C switch configuration.
Figure 7:
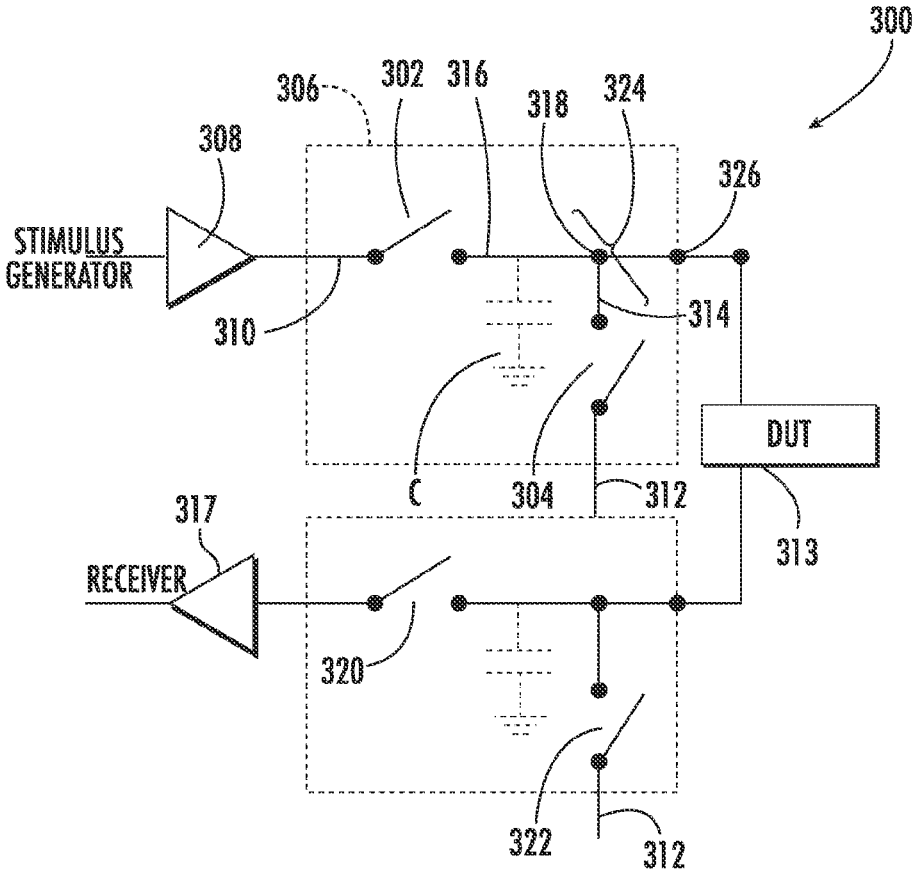
FIG. 7 (PRIOR ART)
FIG. 7 is a schematic representation of a sample circuit commonly used with reed relays.
Figure 8:
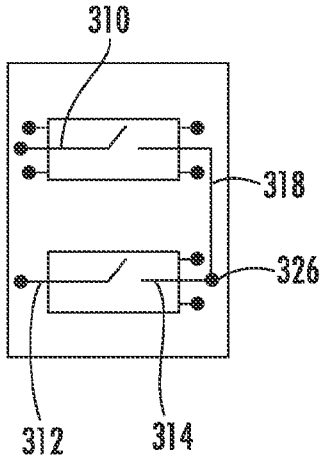
FIG. 8 (PRIOR ART)
FIG. 8 is pictorial implementation of the circuit shown in FIG. 7.

The improved Form C relay 200 of the present invention is shown in detail in connection with FIGS. 9-26 below. The relay of the present invention may be easily used for circuits, such as circuit 300 in FIG. 7 so that this circuit may easily operate at frequencies in the 18 GHz range and above to accommodate the testing of high-speed devices. The relay 200 of the present invention can enable such circuits to operate in the 18 GHz range and higher because RF performance is greatly improved by use of low pass filters, generally referred to as 202, while the high-frequency path is protected using the simulated co-axial signal protecting environment. Also, a DC signal to about 18 GHz on either channel in a dual channel environment, with less than 3 dB signal power loss, can be achieved in a circuit that employs the relay of the present invention. The relay 200 of the present invention is the first to use two filter elements, such as 202*a* and 202*b* as in FIG. 9, to mutually isolate the stub capacitance between the two high frequency paths.

Figure 9:
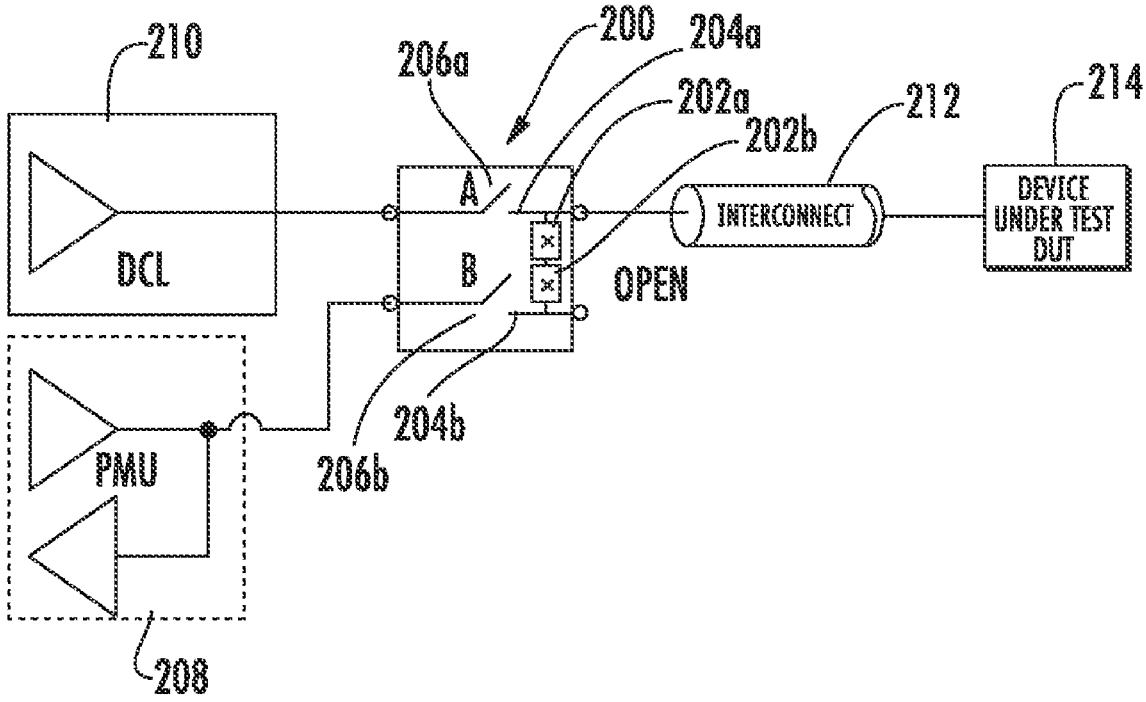
FIG. 9 is a circuit diagram of use of the present invention for use in traditional singled ended ATE architecture.

In accordance with the present invention, low pass filters 202*a* and 202*b*, preferably a pair thereof, interconnect the signal lines 204*a* and 204*b* of two reed switches 206*a* and 206*b* in a parallel, "pseudo" Form C relay arrangement, as seen in FIG. 9. In this figure and in others, the low pass filters 202*a* and 202*b* are representationally depicted as small black boxes, such as in FIG. 9. These bridging low pass filter elements 202 effectively turn two single pole single throw Form A switches 206*a* and 206*b* into a "pseudo" Form C switch configuration where a signal can be routed wherever desired. A good example of this "pseudo" Form C configuration is shown in the circuit diagram of FIG. 9 that generally represents traditional singled ended ATE architecture. In this embodiment, low pass filters 202*a* and 202*b* are, respectively, used for each channel, generally referred to as A and B. The actual physical construction of this arrangement is discussed in detail below in connection with FIGS. 16-26, below. As below, the appropriate circuit board traces can be easily employed to realize the circuit of FIG. 9.

The low pass filter elements 202 create a low frequency bridge between the two form A relays 206*a* and 206*b* to create the "pseudo" Form C relay 200. This provides an advantage in that due to the proximity of the two filter elements 202*a* and 202*b* and the right angle orientation of the element 202*a* and 202*b* to the signal path reduces the magnetic coupling between the adjacent channels A and B, which improves the overall RF performance at frequencies greater than 10 GHz. A suitable low pass filter element 202, that can be used to carry out the present invention, is preferably a ferrite bead filter designed for attenuating GHz-range signals.

Figure 10:
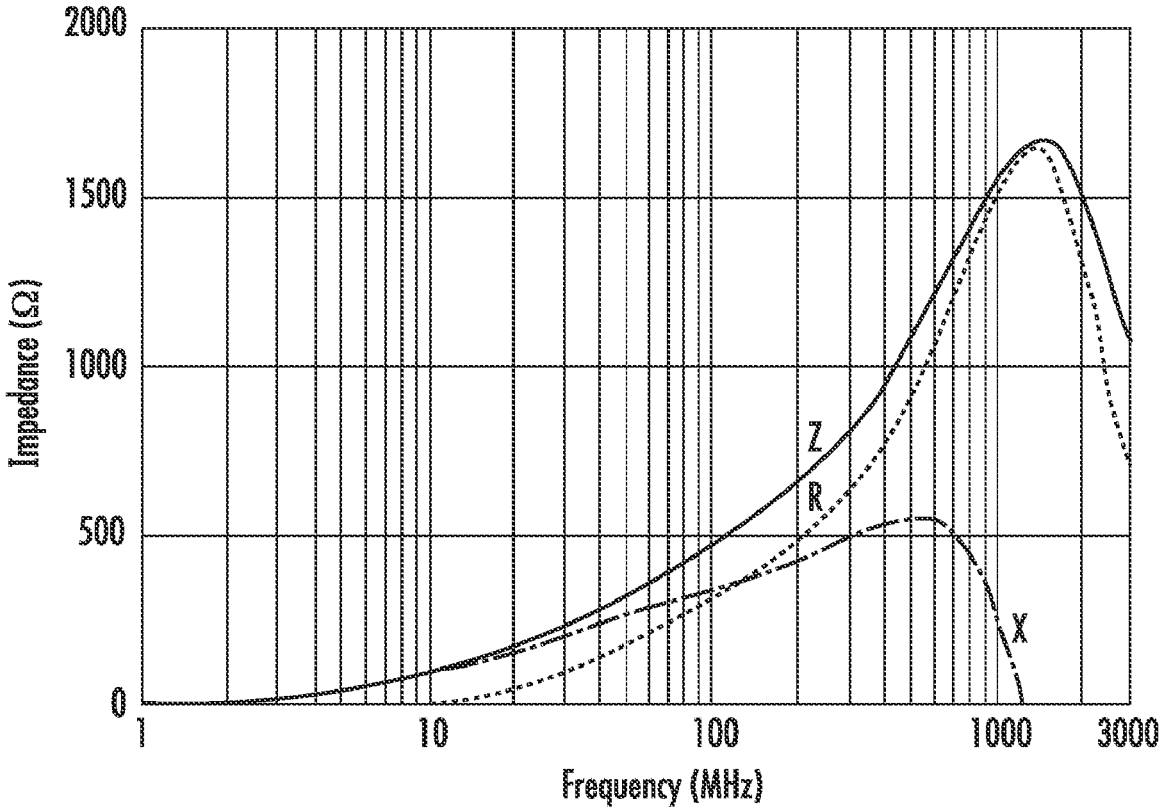
FIG. 10 is a graph illustrating the performance of a low pass filter used in the relay of the present invention.
Figure 12:
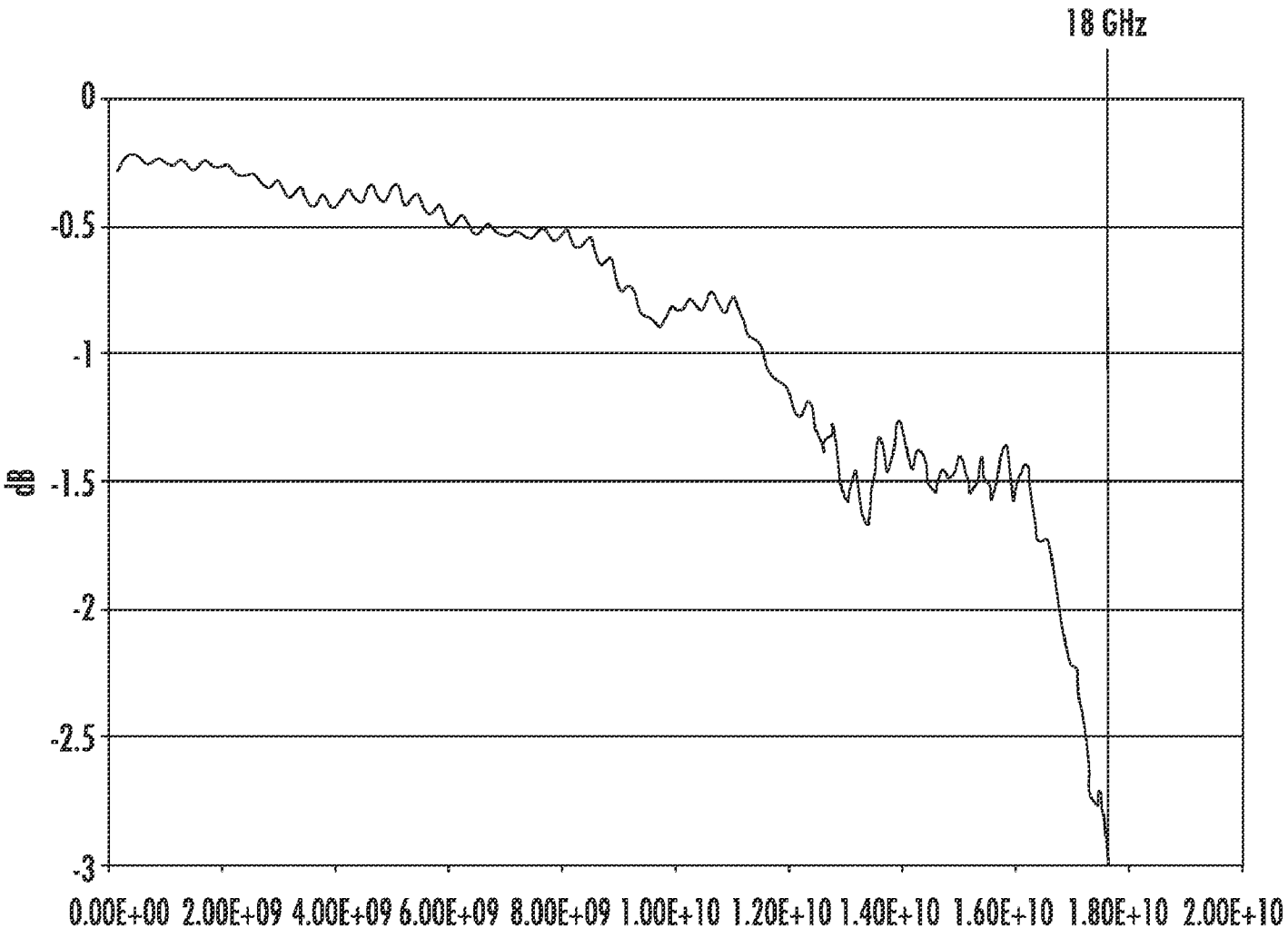
FIG. 12 is a graph showing the bandpass characteristics using, for example, a 7 mm reed switch in accordance with the present invention.

An example of such a preferred ferrite bead filter is Model No. BLM18G Series (0603 Size) manufactured and sold by Murata Manufacturing Co., Ltd. This ferrite bead has the characteristics of: 1) an impedance (at 100 MHz/20° C.) of 470 ohm±25%; 2) an impedance (at 1 GHz/20° C.) of 1800 ohm±30%; 3) a rated current of 200 mA; 4) a DC resistance (max.) of 1.30 ohm; 5) an operating temperature of −55° C. to +125° C.; and 6) for one circuit. The impedance-frequency characteristics of the preferred low pass bead filter 202 is shown in FIG. 10. It should be noted that other low pass filters 202 may be employed and still be within the scope of the present invention.

Still referring to FIG. 9, further details of the interconnection of the "pseudo" Form C relay 200 into an ATE environment is shown. The parametric measurement unit (PMU) 208 attaches to the interconnect 212 downstream of channel A of the device. Thus, the opening of switch A isolates the driver comparator load (DCL) 210 which has a leaky output stage that would corrupt the PMU measurements. As a result, the relay 200 of the present invention provides a high frequency path between the DCL 210 and the DUT (Device under Test) 214. FIG. 11 shows details of test results from a prototype of the Form C relay 200 made in accordance with the present invention, which shows superior performance over prior art circuits that use "pseudo" Form C relays in this environment. As a result, a −3 dB roll-off frequency in the range of 18 GHz, such as 16 GHz, can be successfully achieved by using the unique relay 200 of the present invention. Such results are further illustrated in the graph of FIG. 12 where a 7 mm reed switch was used, by way of example. It should be understood that different types of low band pass filters and reed switches may be used in accordance with the present invention to meet the demands of the application at hand. As can be understood, modifying such filters and reed switches will result in different performance results.

Figure 13:
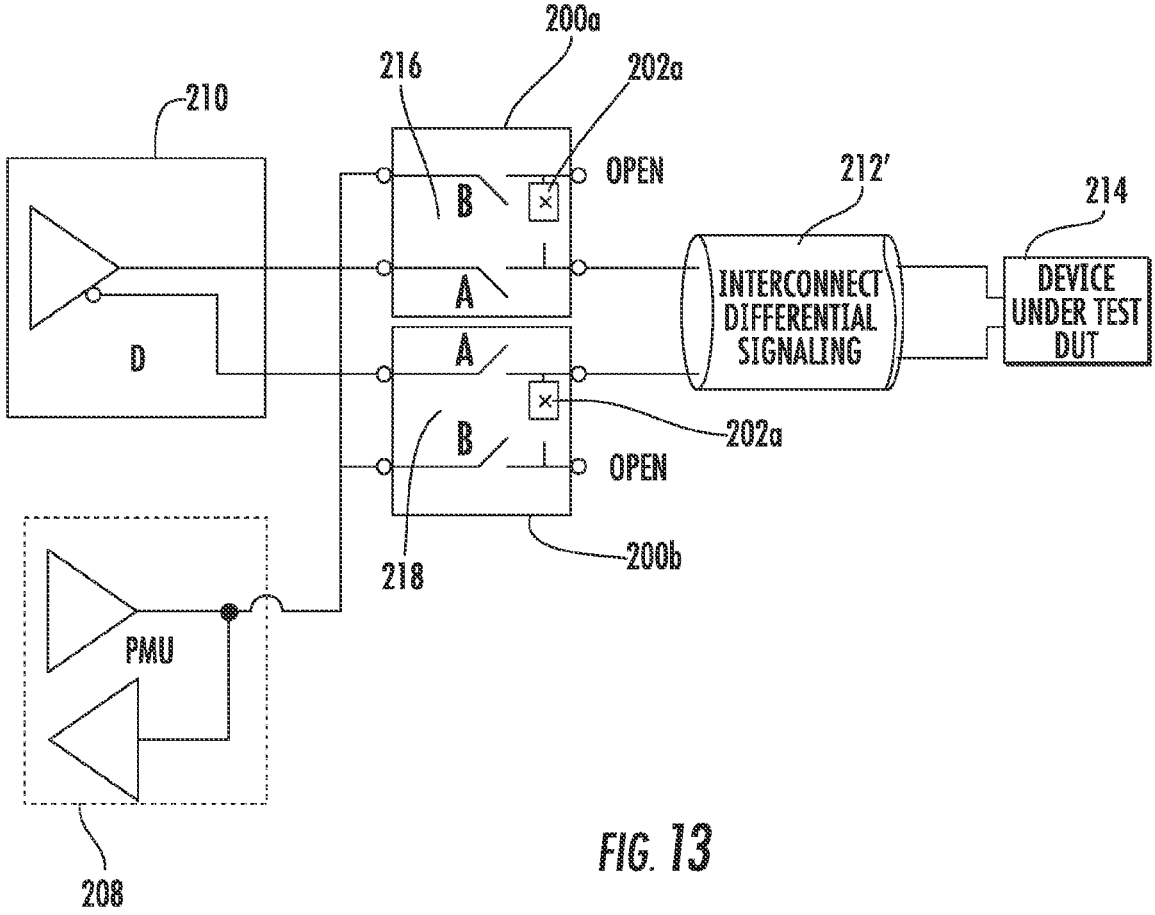
FIG. 13 is a circuit diagram of use of the present invention for use in high bandwidth traditional differential ATE architecture.
Figure 14:
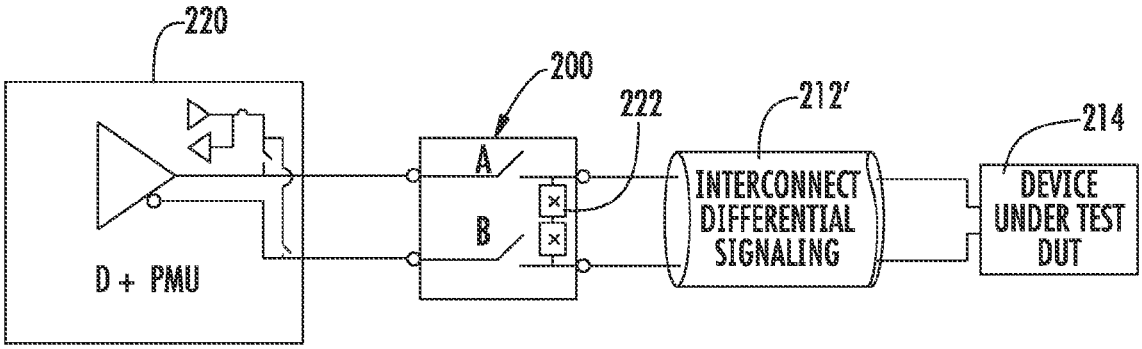
FIG. 14 is a circuit diagram of use of the present invention for use in high bandwidth modern differential ATE architecture with simplified PMU.
Figure 15:
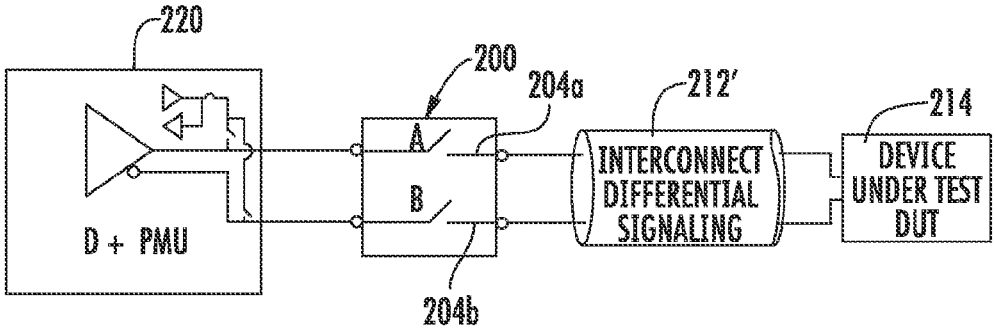
FIG. 15 is a circuit diagram of use of the present invention for use in high bandwidth modern differential ATE architecture with integrated PMU without a link between the signal lines.
Figure 16:
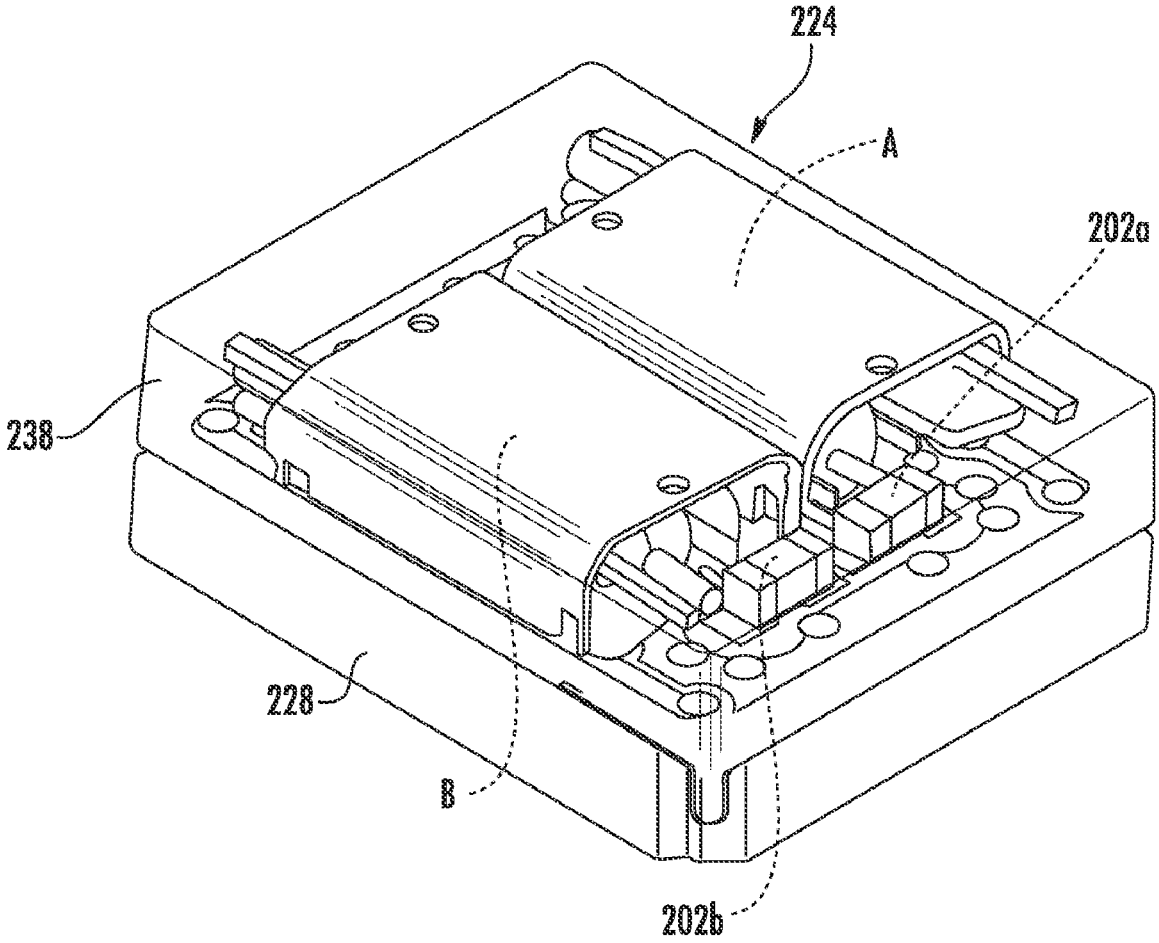
FIG. 16 shows a perspective view of a reed switch package made using the relay of the present invention.
Figure 17:
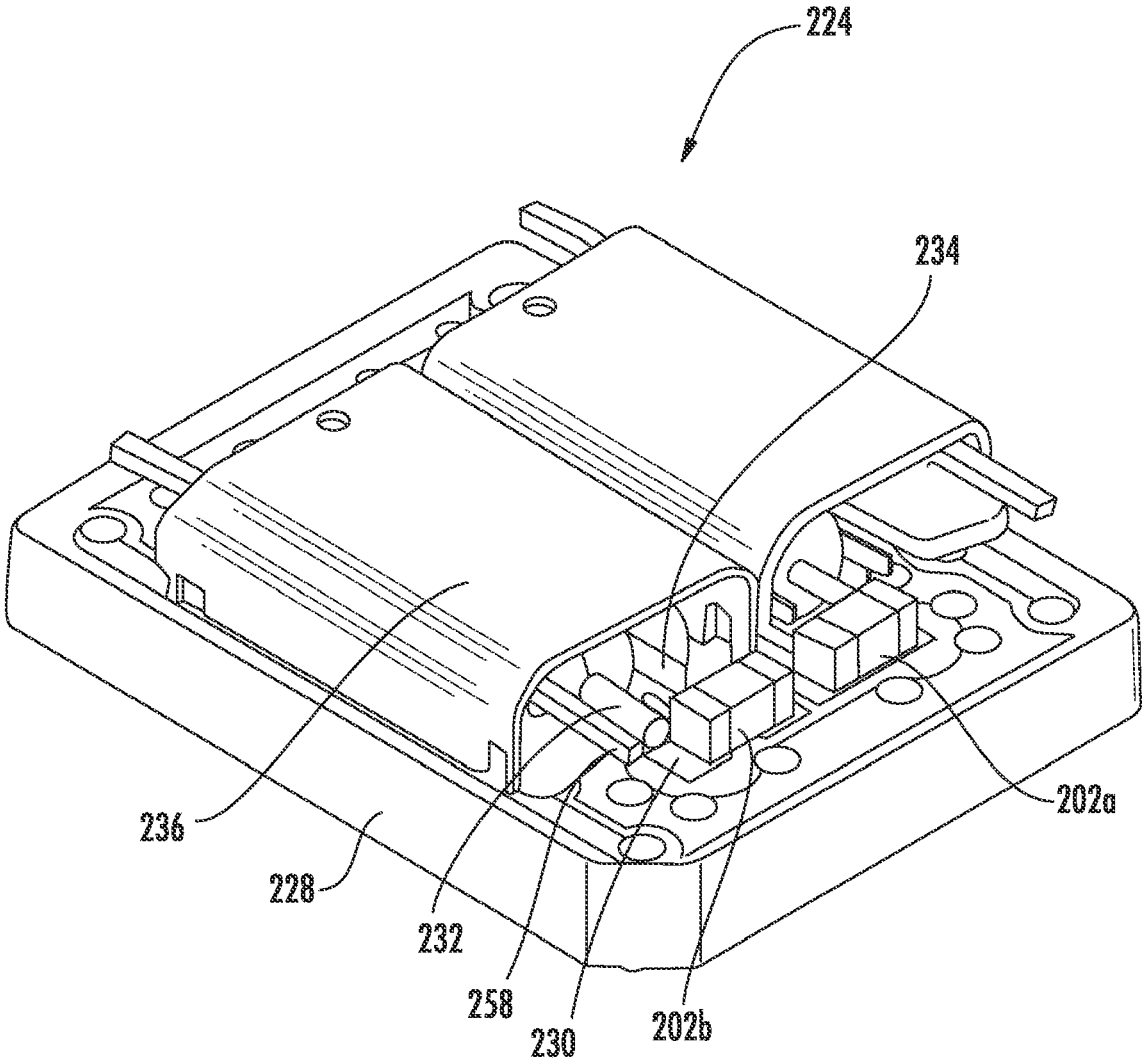
FIG. 17 shows a perspective view of the reed switch package of FIG. 16 with cover removed.
Figure 18:
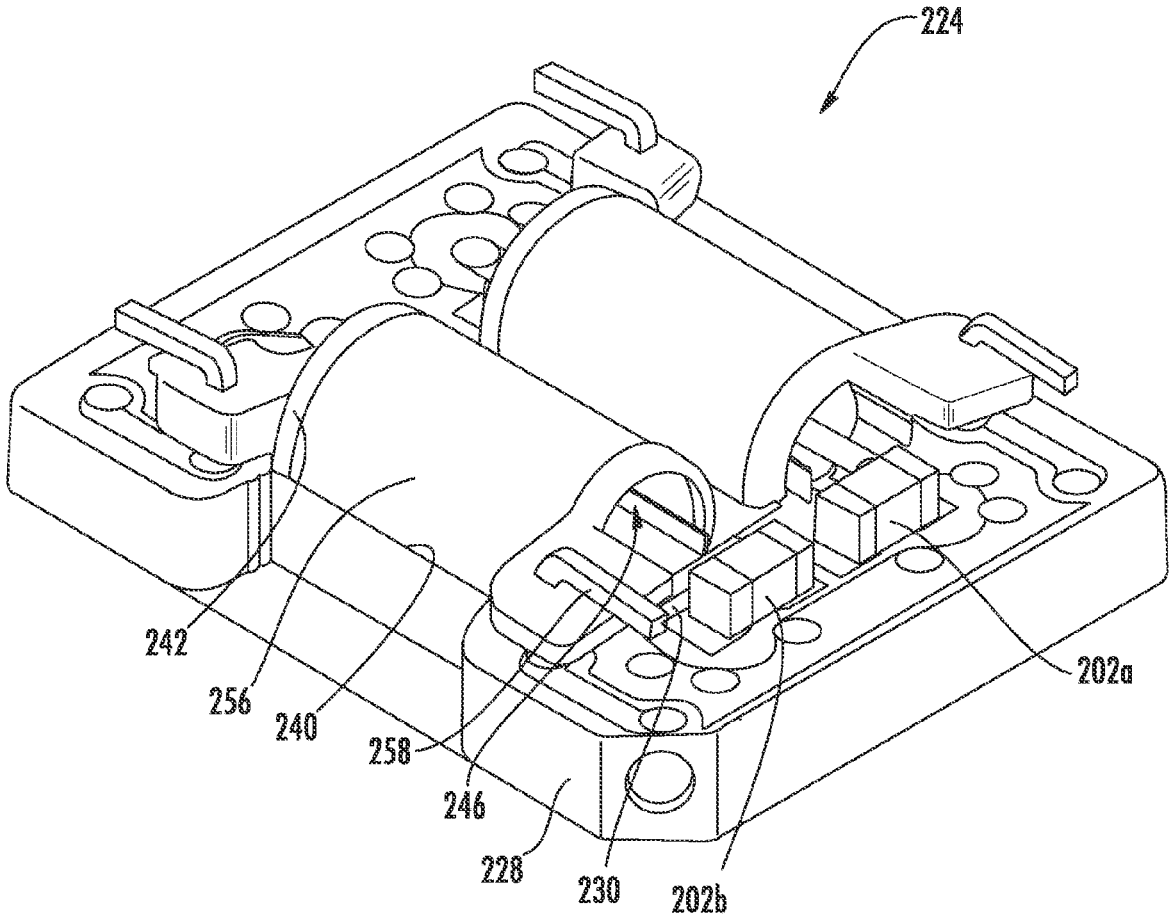
FIG. 18 shows a perspective view of the reed switch package of FIG. 16 with outer shielding covers removed.
Figure 19:
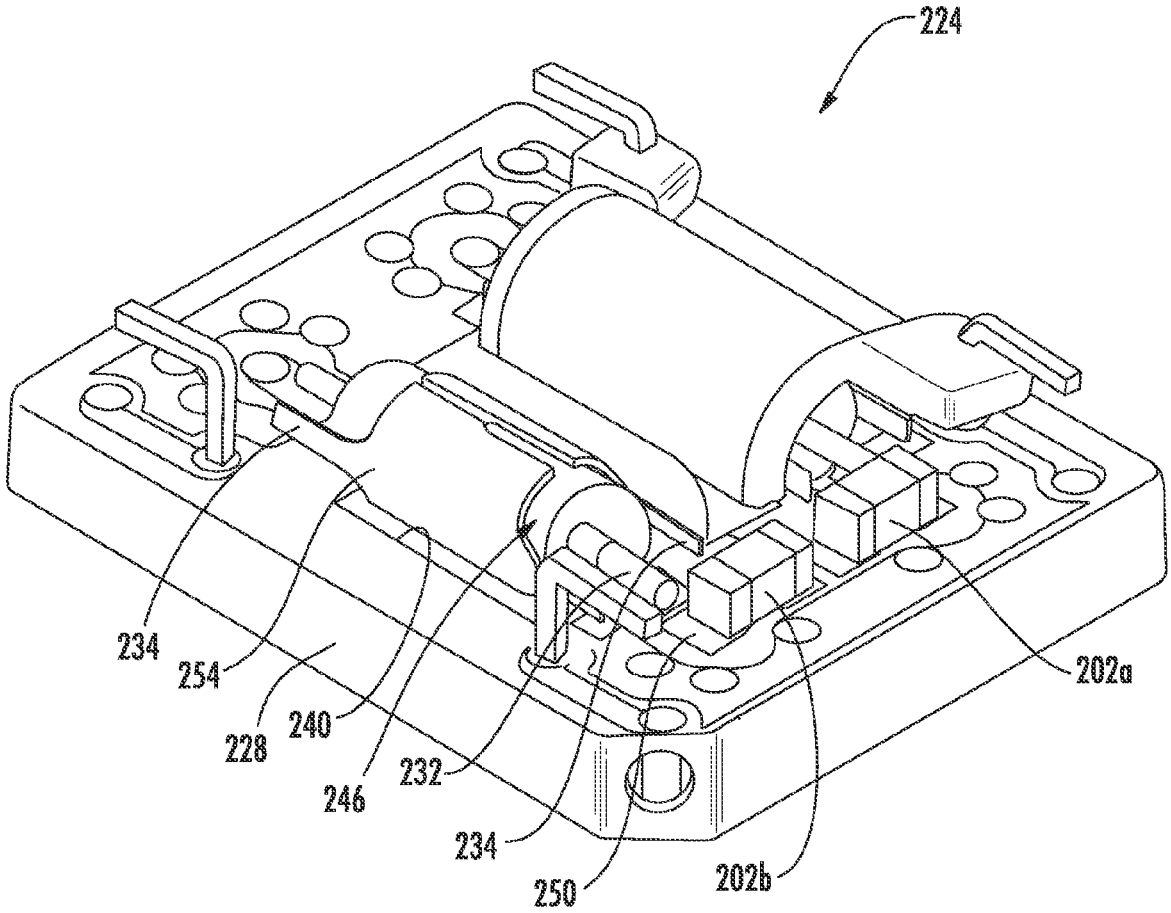
FIG. 19 shows a perspective view of the reed switch package of FIG. 16 with one of the bobbins removed.
Figure 20:
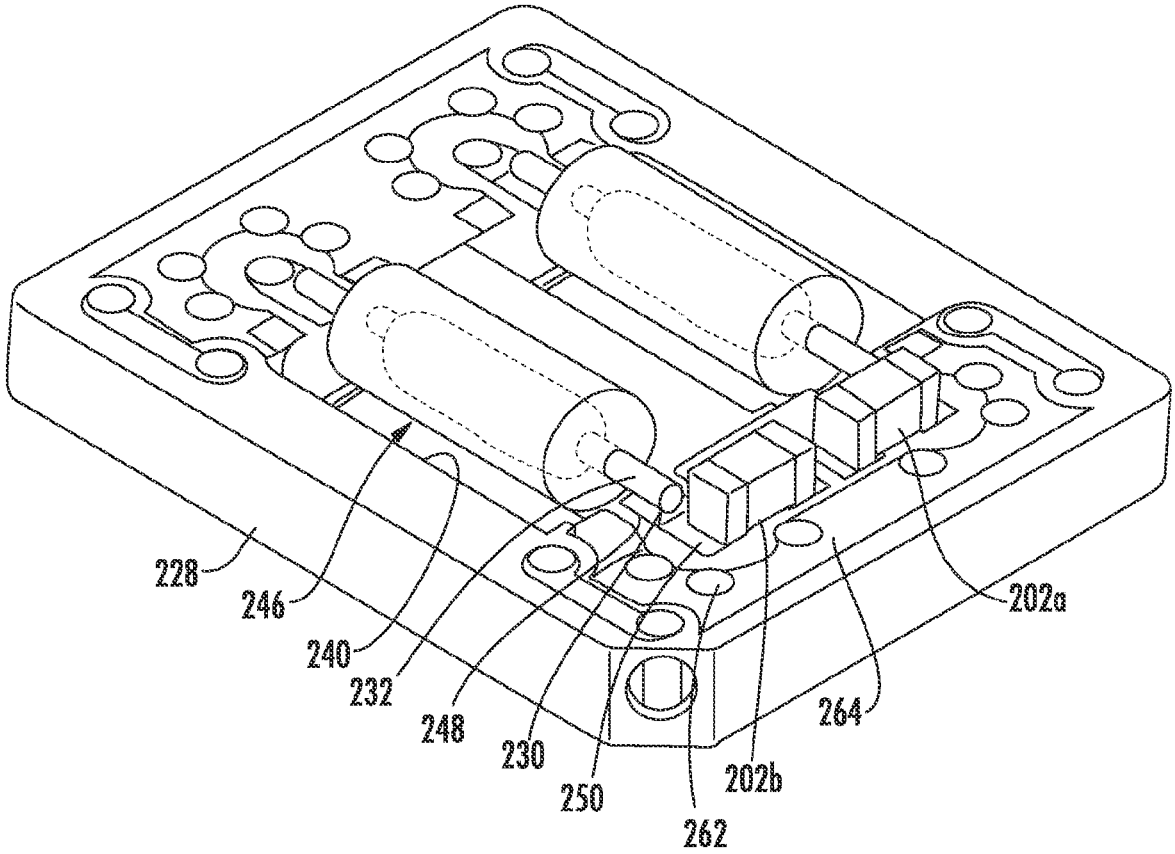
FIG. 20 shows a perspective view of the reed switch package of FIG. 16 with bobbins and shielding removed from about the reed switches.
Figure 21:
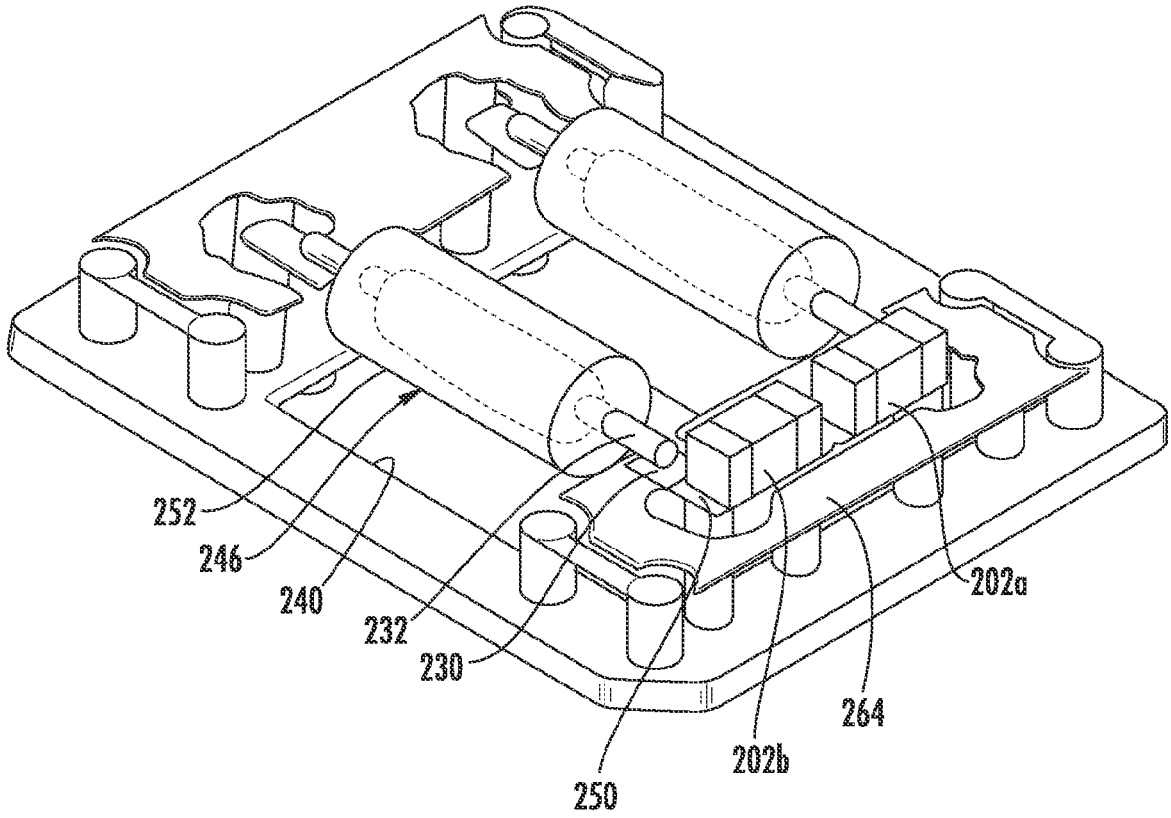
FIG. 21 shows a shows a perspective view of the reed switch package of FIG. 16 with base member encapsulant removed.

Further examples of how the "pseudo" Form C relay 200 of the present invention can be employed in ATE architecture is shown in FIGS. 13-15. In the example of FIG. 13, the environment is of a traditional differential architecture where two (pseudo) Form C relays 200*a* and 200*b* are used for each differential channel to provide optimal PMU measurements at 208 while maintaining high bandwidth connections between the driver and the DUT 214 via interconnect 212' with differential signaling. In this example, a low pass filter 202*a* is employed on only one channel in each "pseudo" Form C relay 200*a* and 200*b*. For example, a low pass filter 202*a* is used on channel B on the top pair of reed switches 216 and on channel A on the bottom pair of reed switches 218.

FIGS. 14 and 15 show examples for use of the present relay in modern differential ATE architecture. FIG. 14 shows the example of ATE architecture with a simplified PMU 220. This architecture better supports higher frequency signaling standards. This includes integrating the PMU systems that have a reduced functionality but still provide some of the necessary functionality that a PMU 208 provided traditionally, as above. In this mode, the relay 200 of the present invention provides a lower frequency bridge, generally to as 222, that is useful for calibration purposes, for example.

Turning now to FIG. 15, a high bandwidth ATE architecture with integrated PMU 220, without a link between the two signal lines 204*a* and 204*b*, is provided. This is another alternative environment that can use the relay 200 of the present invention. In this example, there is an advantage that the electrical performance is maximized and the channel bandwidth pushes higher in the frequency band.

In view of the foregoing, the relay 200 of the present invention can be incorporated into many different types of architecture environments to take advantage of the aforesaid improvements over prior art relays.

It should be noted that a dual Form A relay (not shown) may also be provided in accordance with the present invention. This configuration is the same as the preferred embodiment above except that the filter elements 202, signal traces and associated contact pads are omitted.

The foregoing sets forth how the present invention is new and novel over prior art relays schematically. The present invention also has many structural improvements which are outlined in detail below.

Figure 22:
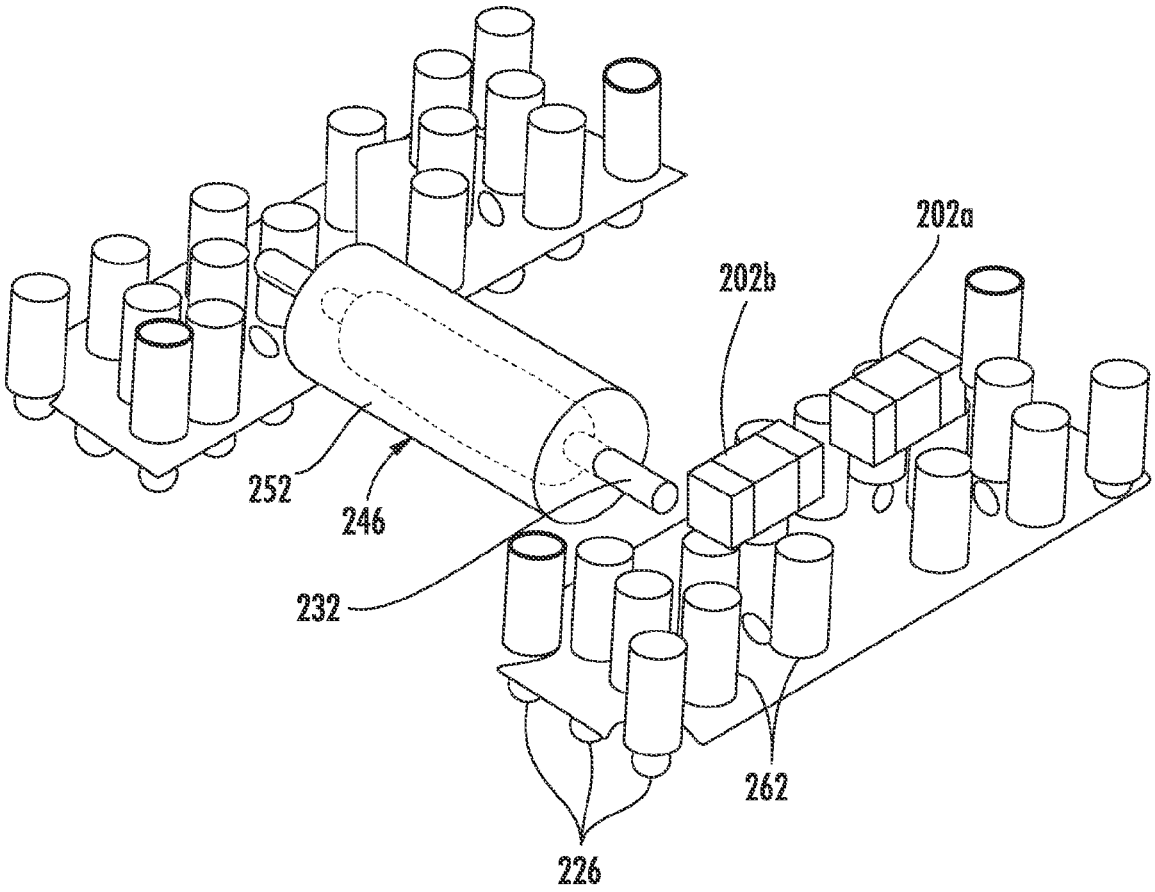
FIG. 22 shows a shows a perspective view of the reed switch package of FIG. 16 with base member and one reed switch removed to reveal a ball grid array.
Figure 23:
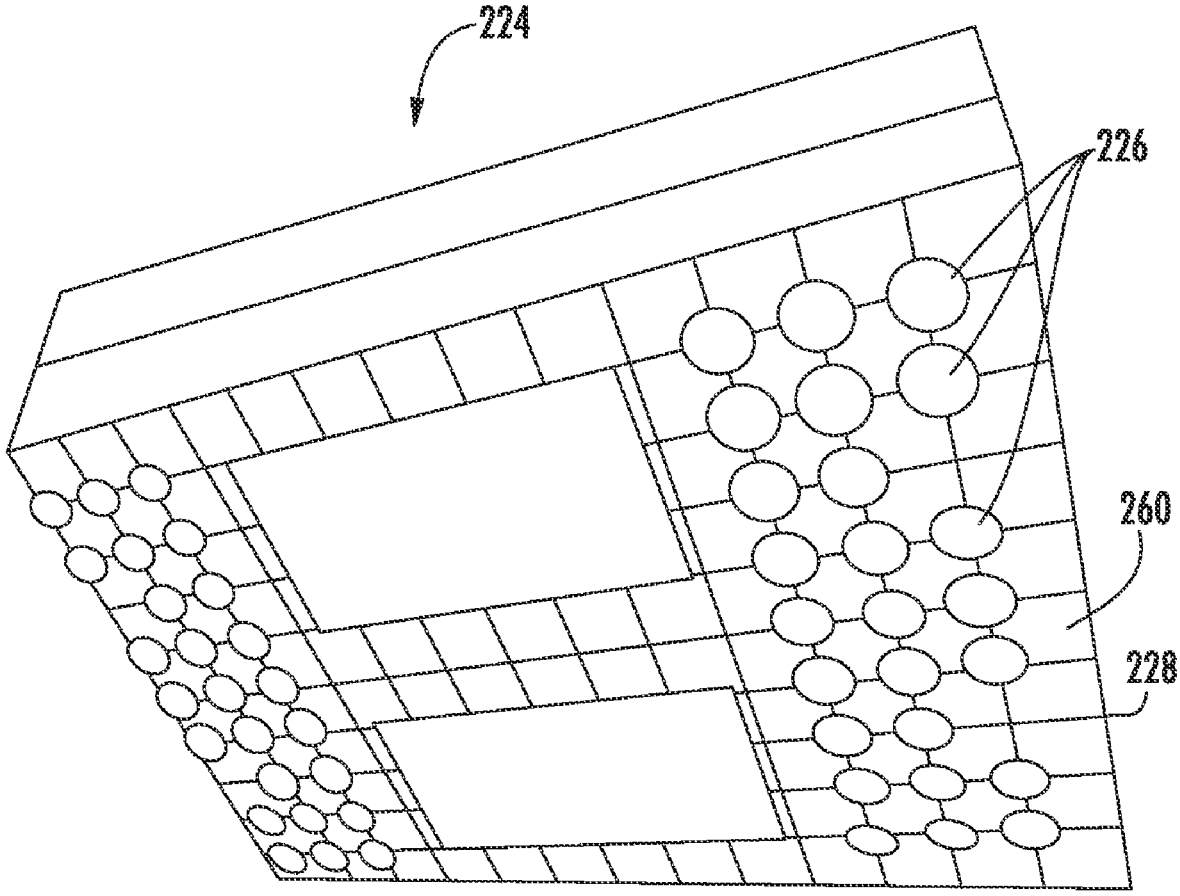
FIG. 23 shows a shows a bottom perspective view of the reed switch package of FIG. 16 to illustrate a example of a ball grid array for electrically interconnecting the package to a circuit board.

FIGS. 16-26 show the relay of the present invention incorporated into a reed relay package device that is suitable for installation on an ATE circuit board (not shown). In general, the package, generally referred as a whole as 224, of the present invention preferably includes two channels A and B with two respective low pass filter elements 202*a* and 202*b*, as above. However, it is possible that more than two channels A and B may be provided in a single package 224 in accordance with the present invention. In this arrangement, the appropriate solder ball interconnections 226, as in FIGS. 22 and 23, are employed for each reed switch corresponding to a given channel. Further, may different types of interconnections may be employed by the package of the present invention. It should be understood that the package 226 of the present invention can accommodate a wide array of electronic devices that require signal lead shielding with a controlled impedance environment.

For ease of discussion, one the construction and configuration of one channel is discussed in detail below. It should be understood that the other channel or channels may be similarly constructed in accordance with the present invention.

A package 226 that employs the relays of the present invention is shown in FIGS. 16-26, which is various stages of removal of components for purposes of illustration and ease of discussion. In this example, the package 226 can be used as part of the circuit 300 shown in FIG. 9 with a bridging pair of low pass filters 202*a* and 202*b*.

The complete reed switch package 226 includes a substrate base 228 along with a number of contact pads 230 for receiving the signal lead 232 and ground leads 234 from the reed switch 236. A metal or non-metallic shell 238 is secured to the substrate base 228 with, for example, a bead of epoxy (not shown) around the perimeter to provide a liquid-tight seal. The entire assembly 224 may be otherwise preferably overmolded with plastic.

The substrate base 228 includes a recessed central portion or aperture 240, as in FIGS. 18-22, for receiving the bobbin portion 242 of the reed device 246 to provide a short, straight signal path and reduce the overall size of the package 224. Contact pads 230 are provided at a seat portion 248 of the substrate base 228 to connect the signal leads 232 and ground leads 234. The reed device 246 is relatively light in weight so as to be supported entirely by the signal lead 232 and ground leads 234. However, other base substrate housings may be employed (not shown) where the bobbin 242 rests on its own seat or where additional contoured portions of the substrate 228 are provided to support the reed device 246.

The low pass filters 202*a* and 202*b*, such as the ferrite beads mentioned above, are secured, such as by soldering, to contact pads 250 which are interconnected to the pads 230 to which the signal leads 232 are electrically connected. This physical interconnection is shown generally in FIGS. 20-22 and best seen in FIG. 21.

Signal leads 232 and ground leads 234 are electrically interconnected to solder balls 226 on the opposing surface of the substrate base 228 for further electrical interconnection to a circuit on a circuit board (not shown), such as one carrying ATE circuitry. This is known as a BGA interconnection. The bottom of the package 224 is shown in FIG. 23, which illustrates such an example ball grid array for such interconnection to a circuit board. Along with the protective shell 238 (or solid encapsulant), a compact reed switch package 224 is provided that is of a surface mount configuration to accommodate high frequency reed switches 246 in a controlled impedance environment.

In particular, the reed switch 246 includes a signal conductor 232 within a glass capsule 252 with an inert gas or vacuum therebetween. Positioned about the glass capsule 252 is a ground shield 254 which is preferably of a cylindrical or tubular configuration but may be of an oval cross-section to accommodate certain reed switches 246 or multiple reed switches in a multiple channel environment. The foregoing assembly is housed within the bobbin 242 which includes an energizing coil 256 therearound. The free ends of the energizing coil are connected to posts 258 which are electrically connected to corresponding solder balls 226 on the bottom surface 260 of the substrate base 228.

As part of the present invention, a co-planar waveguide is provided in the form of electrically conductive through vias. These are preferably provided to further improve performance of the relay 200 of the present invention, such as in the form of package 224. Such a configuration is shown in commonly owned U.S. Pat. Nos. 6,052,045, 6,025,768, RE38381 and 6,683,518 and can easily accommodate the unique bridge filters 202*a* and 202*b* of the present invention.

As to the through via construction, the contact pads 230, 250, for example, are electrically interconnected to corresponding solder balls 226 on the bottom surface 260 of the substrate base 228, which can be seen in detail in FIG. 22. Thus, the interconnection of the signal leads 232 and ground leads 234, via the contact pads 230, 250 to the solder balls 226, is shown.

The signal leads 232 and ground leads 234 are electrically interconnected to solder balls 226 on the bottom surface 260 of the substrate base 228 by electrically conductive vias 262, as best seen in FIG. 22, through the plane of the substrate base 228. In this preferred embodiment, a conductive via 262 is provided for the signal lead 232 and each of the ground leads 234 to maintain a desirable 50 ohm environment. Preferably three or more electrical conduits or vias, generally referred to as 262, are provided through the plane of the substrate base 228.

As stated above, the signal through the reed switch 246 is optimized when the co-axial configuration is maintained as much as possible through the entire body of the reed switch package 224. The through-plane wave guide of the present invention connects to solder balls 226 on the bottom surface 260 of the substrate base 228. Respective through vias 262, that are connected to trace 264 in FIG. 20, for example, are used to create the desired coplanar waveguide about the signal via 262 connected to pad 250. While this configuration is preferred, other configurations may be used.

The impedance $Z_2$ through the plane of the substrate base 228 is a function of the thickness of the dielectric material of the substrate base 228, the width of the signal via 262, the distance between the signal via connected to pad 250 and neighboring ground vias 262, and the dielectric constant of the dielectric material of the substrate base 228.

At the bottom surface 260 of the substrate base 228, a true co-axial arrangement is formed by providing appropriate solder balls 226 connected to the through vias 262 connected to ground trace 264, as above. This loop of grounding forms an actual co-axial shield conductor in similar fashion to that found in the cylindrical shield conductor 254 about the reed switch 246 itself. The shielding 254 is not expressly for EMI shielding and the protection of neighboring components, but to contain and improve the fidelity of the signal of the reed switch 246. At the co-axial ground loop, the impedance $Z_3$ is a function of the diameter of the signal via 262, the diameter of the ground loop and the dielectric constant of the insulative substrate base 228.

The present invention employs of a wave guide to simulate a true co-axial environment. This unique wave guide extends through the actual plane of the substrate base 228 to the solder ball interconnections 226 at the bottom of the package 224. Unlike the prior art, the wave guide or simulated co-axial arrangement is continuous from the reed switch 246 itself to the solder ball interconnections 226 where a microstrip or wave guide is typically present on the circuit board (not shown). As a result, the signal is protected from uncontrolled discontinuities. The shielding protection for the signal lead 232 is extended and controlled from the actual body of the reed switch 246 to the actual electrical interface to the circuit board. In accordance with the present invention, the overall impedance of the signal transmission path is consistent and matched to the desired overall impedance value thus obviating the need for substantial circuit tuning by the user.

As can be understood, present invention provides either an actual or simulated co-axial environment for superior protection of the signal lead of a reed switch. The through-plane conductive vias enable a continuous co-axial environment to be provided from the reed switch 246 directly down to the electrical interconnection to a circuit board (not shown). In most applications, due to the frequency of the transmitted signal by the reed switch 246, a complete continuous ground loop is not needed to provide a co-axial arrangement for signal lead protection. In the present invention, the ground conductor vias are preferably on a 1.27 mm or 1.00 mm grid. Common frequencies for the reed switch are in the 1.0 to 8.0 GHz range. At these frequencies, the wavelengths are in the 300 mm to 40 mm range. The wavelengths are too long to sense any discontinuities of the "simulated" co-axial arrangement. Therefore, the simulated co-axial arrangement is essentially identical in effectiveness compared to a true full co-axial arrangement. As a result, this topology provides for effective shielding until the wavelength gets so small that the conductor via grid will be seen as discontinuous.

For the grids discussed above, effective shielding can be realized with the present invention with wavelengths as low as 8 mm with a frequency of 18 GHZ and greater. Greater or fewer conductive vias through the plane of the substrate base may be employed depending on the device within the package and the application at hand.

While the package 224, using the relay 200 of the present invention, is shown to employ solder balls 226 in a BGA package for electric interconnection to a circuit board, other types of interconnections may be employed such as pin grids, land grids. Further, ball grid array socket arrangement may be used to facilitate removal or replacement of the package when desired. The substrate base body is preferably a dielectric material, such as plastic, but may be manufactured of any other material suitable for electronic device packages. For example, high-temperature FR-4 PCB material is preferably used for the dielectric material. The vias 262, employed in the present invention, may be made of known conductive materials, such as copper, aluminum, tin and other known alloys in the industry.

The reed switch package 224, in accordance with the present invention, is preferably fully enclosed in metal or non-metallic shell or may be fully overmolded for additional protection of the device. Alternatively, the reed switch package 224 may be partially enclosed with a metal or non-metallic shell, partially overmolded with plastic or partially encapsulated using other materials to provide an air-tight and/or liquid-tight seal in a low profile configuration.

Figure 24:
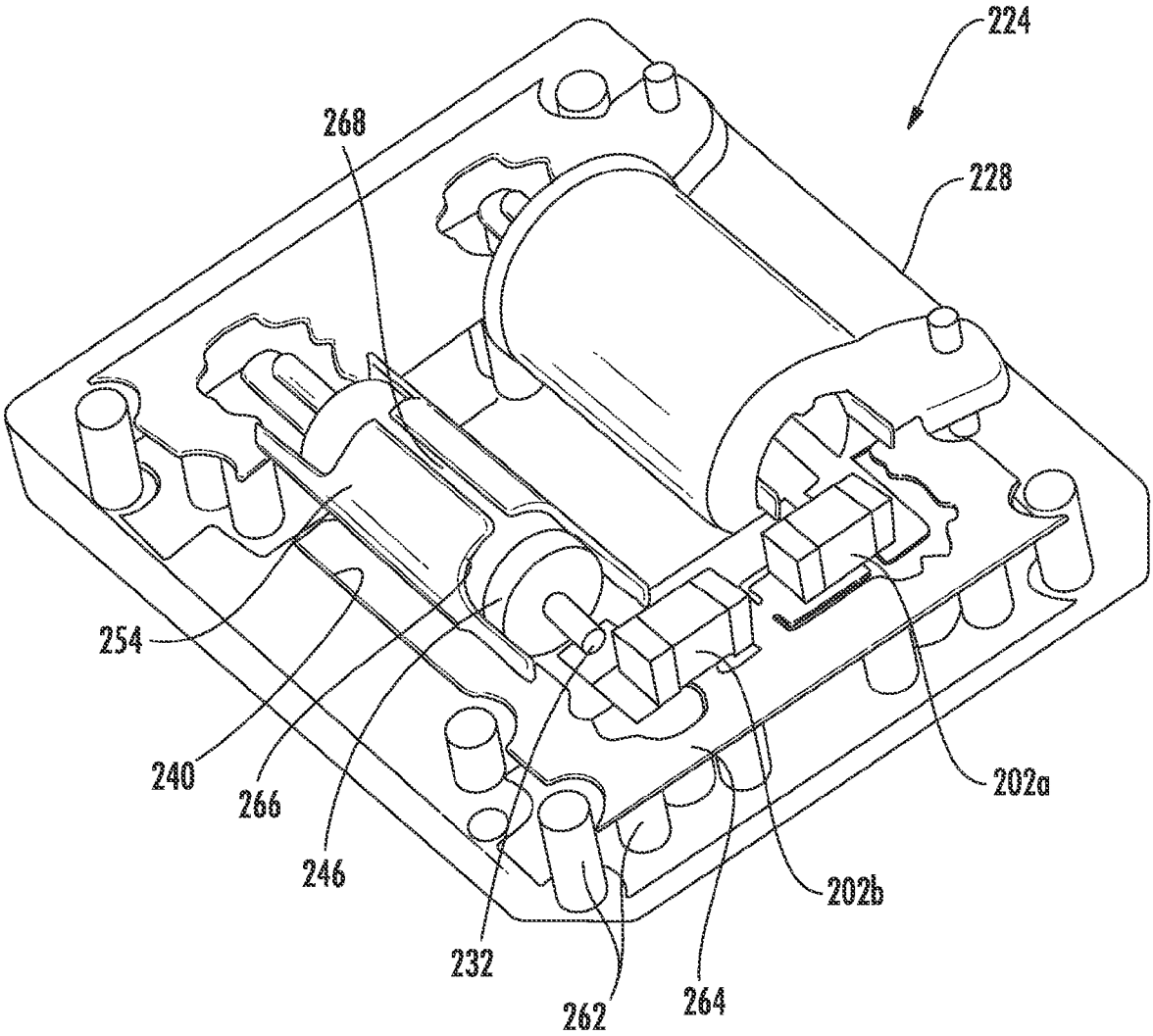
FIG. 24 shows a shows a perspective view of the reed switch package of FIG. 16 with cover and a portion of the base removed to illustrate profiling of the RF shielding in accordance with the present invention.
Figure 25:
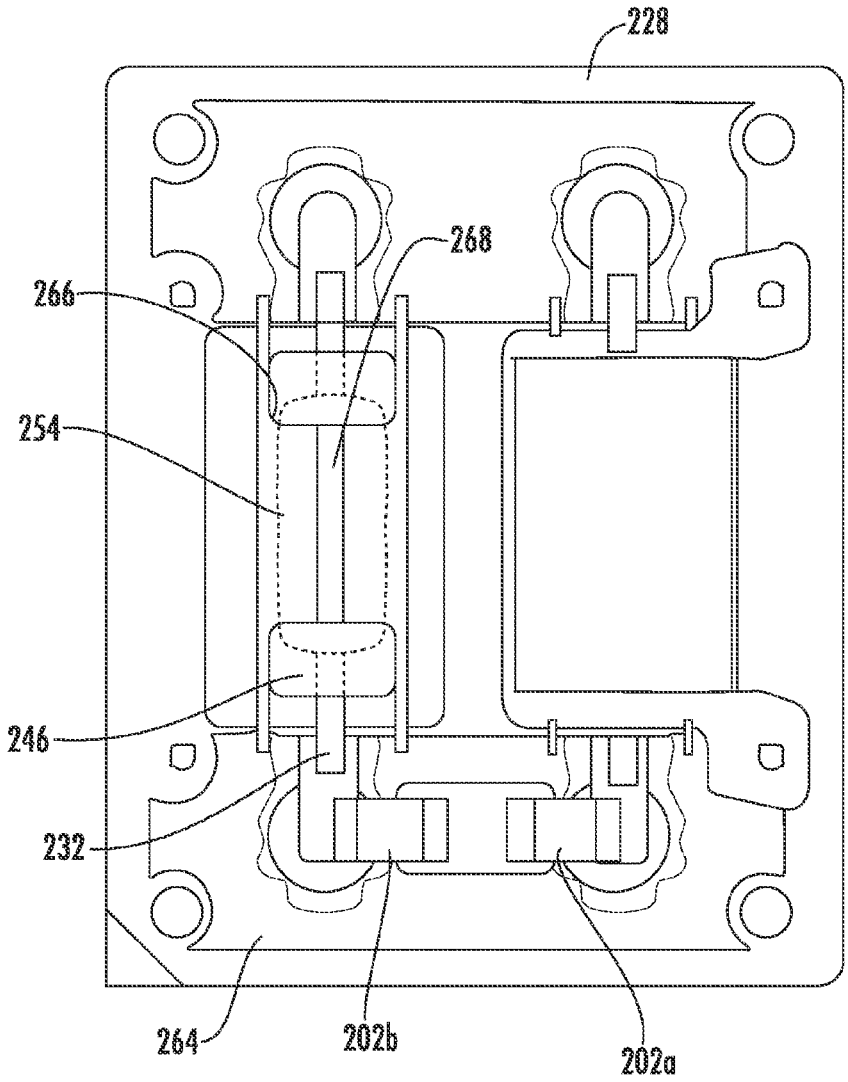
FIG. 25 is a top view of the reed switch package shown in FIG. 24.
Figure 26:
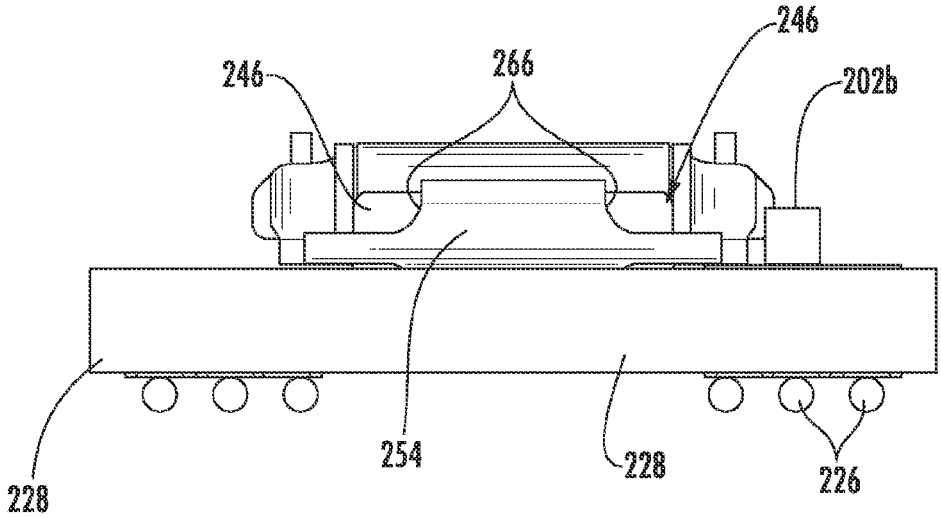
FIG. 26 is a left side elevational view of the reed switch package shown in FIG. 24.

Further, in accordance with the present invention, the RF shield 254 surrounding one or more of the individual switches 246 can be profiled, which is can be best seen in FIGS. 24-26. This profiling is optimized using full-wave electromagnetic modeling software to compensate for differences in capacitance at the point in the transmission line where the seal of switch glass 252 are positioned, thereby reducing impedance discontinuities at those two positions. More specifically, the region near the seal of the glass 252 of each switch creates a low impedance area on the transmission line. The shape of the shield 254, namely the use of cut-outs 266 and the like, raise this impedance so that it is approximately 50 ohms, thereby matching it to the ATE circuit environment.

It can be readily seen that the shape of the RF shield 254 has a certain configuration that preferably includes cut-outs 266 on each opposing and a longitudinally running slot 268. Thus, the combination of the tuning of the RF shielding 254 and the co-planar waveguide, as above, a consistent 50 ohm signal path can be achieved to match the ATE circuit environment.

In view of the foregoing, a improved "pseudo" Form C relay 200 can be incorporated into a package 224 that can operate at much higher frequencies, such as in the 18 GHz range and above, to accommodate modern ATE circuitry.

It would be appreciated by those skilled in the art that various changes and modifications can be made to the illustrated embodiments without departing from the spirit of the present invention. All such modifications and changes are intended to be covered by the appended claims.

What is claimed is:

1. A reed relay device, comprising:

a support substrate having a first side and a second side;

a first reed switch having a main body with signal input and a signal output;

a second reed switch having a main body with a signal input and a signal output;

a first ground shield surrounding the main body of the first reed switch;

a second ground shield surrounding the main body of the second reed switch;

a plurality of ground terminals on the first side of the support substrate connected to the first ground shield;

a plurality of ground terminals on the first side of the support substrate connected to the second ground shield;

a first signal via routed through the substrate and interconnected to the signal output of the first reed switch;

a second signal via routed through the substrate and interconnected to the signal output of the second reed switch;

a first plurality of ground vias routed through the substrate and interconnected to the first ground shield;

a second plurality of ground vias routed through the substrate and interconnected to the second ground shield;

a plurality of contacts on the second side of the support substrate respectively electrically interconnected to the first signal via, the second signal via, the first plurality of ground vias and the second plurality of ground vias; and at least one filter element electrically bridging the signal output of the first reed switch with the signal output of the second reed switch.

2. The reed device package of claim 1, wherein the support substrate has a plurality of seats for respectively receiving the first reed switch and the second reed switch.

3. The reed device package of claim 1, wherein the plurality of contacts are solder balls.

4. The reed device package of claim 2, wherein the first ground shield and the second ground shield are profiled to compensate for differences in capacitance at the point in the transmission line where the respective glass seals of the first reed switch and the second reed switch are positioned to reduce impedance discontinuities at those two locations.

5. A reed relay device, comprising:

a first reed switch with signal input and a signal output;

a second reed switch with a signal input and a signal output;

at least one low pass filter element electrically bridging the signal output of the first reed switch with the signal output of the second reed switch;

whereby stub capacitance is reduced and RF performance is improved.

* * * * *